United States Patent [19]

Langer

[11] Patent Number: 4,867,274

[45] Date of Patent: Sep. 19, 1989

[54] SCAFFOLD SYSTEM

[76] Inventor: Ruth Langer, Im Weinberg 13, 7129 Güglingen Baden-Württemberg, Fed. Rep. of Germany

[21] Appl. No.: 147,689

[22] Filed: Jan. 25, 1988

[30] Foreign Application Priority Data

Jan. 24, 1987 [DE] Fed. Rep. of Germany ..... 3702057

[51] Int. Cl.[4] ..... E04G 7/00; F16B 7/00

[52] U.S. Cl. ..... 182/179; 52/638; 403/49

[58] Field of Search ..... 182/178, 179; 403/49, 403/246, 190–192, 292; 52/638

[56] References Cited

U.S. PATENT DOCUMENTS

| | | | |
|---|---|---|---|
| 1,797,691 | 3/1931 | Merrill | 403/292 |
| 4,044,523 | 8/1977 | Layher | 182/179 |
| 4,180,342 | 12/1979 | Layher | 403/49 |
| 4,372,424 | 2/1983 | Langer | 182/179 |
| 4,493,578 | 1/1985 | D'Alessio | 182/178 |
| 4,603,756 | 8/1986 | Layher | 182/178 |
| 4,718,787 | 1/1988 | Bahloul | 182/179 |

FOREIGN PATENT DOCUMENTS

| | | | |
|---|---|---|---|
| 6407732 | 1/1965 | Netherlands | 403/292 |

*Primary Examiner*—Reinaldo P. Machado
*Attorney, Agent, or Firm*—Theodore J. Koss, Jr.

[57] ABSTRACT

The system includes vertical posts with apertured disks secured thereto at intervals, coupling heads, wedge-like keys, scaffold pipes, coupling head extensions, and tank-link heads. Each coupling head has a horizontal slot receiving an apertured disk when the head is pushed into mounted position thereon, and has top and bottom key-receiving openings above and below such slot. A wedge-like key extends down through the top key-receiving opening, through a disk aperture, then through the bottom key-receiving opening, fastening the coupling head to the disk. Coupling heads for horizontal scaffold pipes have extensions insertable into the pipes. Diagonal scaffold pipes have tang-link heads, whose tank has an aperture for a pivot provided on an associated coupling head. Conventionally, the disks, coupling heads and pipes are all made of steel, the disks of 9 mm thickness and 122 mm diameter. The disclosed lighter-weight version employs disks and scaffold pipes made not of steel, but of light metal such as aluminum. The coupling heads although still of steel are differently designed, employing a smaller volume of material and thus lighter in weight. The disks are of 10 mm thickness and 124 mm diameter, producing a 33% loadability increase. Numerous other dimensional and configurational modifications of the standard elements compensate for any structural strength inferiority compared to the standard elements, but the herein disclosed lighter-weight versions thereof remain compatible with, and can be freely intermixed with, the heavier-weight standard elements.

16 Claims, 10 Drawing Sheets

SCAFFOLD SYSTEM

BACKGROUND OF THE INVENTION

The invention concerns scaffold systems.

Most especially, the invention concerns a known, standardized scaffold system, having the following features:

vertical posts;

on the vertical posts there are secured apertured, annular disks spaced along the lengths of the posts at intervals corresponding to the grid pattern of the scaffold system;

horizontally and/or diagonally extending elongate scaffold elements which are fastened to the annular apertured disks by means of coupling heads;

the coupling heads have disk-receiving slots by means of which the coupling heads engage the apertured disks at both the bottom and top faces of the disks;

the coupling heads have key-receiving spaces formed by paired key-receiving openings, the top opening being located above the disk-receiving slot of a respective coupling head, the bottom one being located below the disk-receiving slot, for keys that extend down through the top key-receiving opening, then through a disk aperture, and then through the bottom key-receiving opening of the coupling head;

the keys are each wedged against the radially outer margin of a disk aperture and against the radially inward bearing surfaces of the key-receiving space of a respective coupling head;

the keys are provided at their bottoms with thickened portions that prevent loss of the keys;

the bottom key-receiving openings are broader than the upper end region of the top key-receiving opening;

the lateral boundaries of the coupling heads converge in wedge-like fashion towards the common center axis of the post and associated disks;

the radially inward bearing surfaces of the coupling heads, bearing against the periphery of respective posts, are of part-cylindrical configuration and have a radius equal to the outer radius of the posts;

the radially inward bearing surface of each coupling head has a height greater than or equal to the height of the elongate scaffold elements;

the radially inward bearing surfaces of the coupling heads have through-openings which extend all the way through to the key-receiving spaces in the interiors of the coupling heads;

the coupling heads are made of cast or forged steel;

those coupling heads to which elongate scaffold elements are secured are provided with extensions which are fastened to or welded to such coupling heads and which have a profile such as to extend into and engage the interiors of such elongate scaffold elements;

these extensions have recesses or apertures, and the elongate scaffold elements that engage the exterior of the extensions have deformed regions which are received in such recesses or apertures, or else such elongate scaffold elements are held in mounted position on such extensions by means passing through such apertures, such as screws, rivets, or the like;

the scaffold is generally of rectangular geometry and includes elongate scaffold elements each of which extends horizontally in a single one of the x- and y-directions of the scaffold geometry, but if the scaffold also includes diagonal elongate scaffold elements extending in two or more of the x-, -y, and z-directions, then these latter are at their ends provided with flat tangs having cylindrical bores, with rotary pivot members extending through such bores, these pivot members being parts of coupling heads which are like the coupling heads set forth above but, in contrast thereto, not provided with the aforementioned extensions.

A scaffold system exhibiting the above listed features is known from West German patent DE-PS 24 49 124, as well as being known from very widespread use of the construction there disclosed.

Such scaffolds are in general formed by posts made of steel pipe and elongate scaffold elements made of steel pipe or of other profiled steel stock. In certain instances, use has even been made of scaffolds the constituent pipes and/or elongate scaffold elements of which have been made of light metal, not steel, but this in conjunction with many further structural features and structural particulars not customarily employed. This is chiefly to be attributed to the fact that, with the loads presented to the various junctions of a modular scaffold system, high demands are placed upon such junctions, demands which in actual practice either cannot be realized at all when light metal is used or else can be realized only with great difficulty, and even then only if one employs certain combinations of structural materials and furthermore resorts to various non-customary design particulars.

Accordingly, for modular scaffold systems of this type it is, practically speaking, only steel constructions that find substantial use. However, with regard to portability, erection and dismantling these have the very considerable disadvantage of the heavy weight of their individual structural elements. Especially when doing indoor work, use is very often made of tower-like (i.e., stationary) or transportable (travelling) scaffold structures, e.g. in renovation and repair work, for setting up video or filming equipment that is to be located at a considerable height, and so forth, it being necessary that such scaffold structures be quickly erected, quickly dismantled, and in certain instances moved about, especially in partly or completely dismantled state. Also, there is often a need for scaffold structures that can be very quickly set up in confined spaces, solely by means of manual labor, and without the aid of transport equipment such as forklift trucks and/or hoisting equipment for moving the constituent elements of the scaffold structure to where they are needed; examples are: where the scaffold is to be erected inside a power plant boiler and the various scaffold elements must be introduced through a boiler manhole; or, inside the dust-arrester or antipollution installation within a power plant, in the event of malfunction or clogging of a nozzle or other element it may be necessary to erect a scaffold having one or more platforms. Such scaffolds, with or without platforms, often must be constructed very quickly by a small work crew, often with the elements of the scaffold being handed from one crew member to the next, in bucket-brigade fashion, from outside the installation site to inside the installation site, and then later be dismantled no less quickly, the handing-over of constituent elements then proceeding in the reverse direction. Often, furthermore, and as already said, all this must take place in extremely confined circumstances. In such applications, the ability quickly to erect and dismantle scaffolds is of considerable economic importance. In the examples just given, the repair itself may require only a short time. In that event, it becomes a question of economy, and of considerable inconvenience, if the particular installation must suffer a protracted down-time merely for the purpose of erecting and then dismantling the scaffold needed to make the quickly performed repair.

For such scaffolds, usually of tower-like form but of differing heights, there accordingly exists an especial need for scaffold elements optimized relative to weight, portability, and the configuration of the interconnecting coupling elements.

Furthermore, one should really adopt the view that scaffold elements that are made of light metal, not steel, are to be used wherever possible. In many respects small departures in construction, relative to the structural features of standard scaffold constructions that utilize steel members exclusively, should even be viewed as meriting serious consideration if any can be found that would permit as many of the scaffold elements as possible to be made of light metal. Also, it would be extremely helpful if any such modified scaffold elements could be freely intermixed with the steel elements of standard modular scaffold systems. On the other hand, if one were to resort to such free intermixing, one must be assured that the resulting scaffold structure will be able unproblematically to absorb and withstand the forces to which it will be subjected, especially at the various junctions at which scaffold elements are coupled to one another.

SUMMARY OF THE INVENTION

It is accordingly a general object of the invention to provide a scaffold system generally of the type set forth above, but greatly optimized with regard to weight and portability, and with regard to ability to absorb, bear and transmit the load forces to which it will during use be subjected, especially forces developing at the junctions between scaffold elements.

In accordance with the invention, various ones of the following features can be employed:

the coupling heads that couple elongate scaffold elements to vertical scaffold posts and have bearing surfaces radially bearing against the scaffold posts, can be modified as to their configuration in such a manner as to exhibit a dimensional decrease proceeding in the radially outward direction, i.e., in the direction away from the associated post, exhibiting especially a decrease, proceeding in said direction, of the vertical dimension between the top and bottom boundaries of the coupling head, the dimensional decrease being such that the coupling head at its radially outer end become reduced to dimensions corresponding to the diameter, or as the case may be to the height, of an elongate scaffold element that is fastened to such coupling head;

the coupling heads are so configured that the outer boundaries of their radially inward bearing surfaces are located at approximately equal vertical distances from the region at which the respective wedge-like key is jammed against the radially outer margin of a respective disk aperture;

the extensions with which the coupling heads are, when necessary, provided are hollow an have interior peripheral wall defining an interior space of truncated-cone shape, the peripheral wall, at the end thereof near to the disk-receiving slot of the coupling head, exhibits a transitional region at which it curves inwardly;

the top key-opening walls are designed to form lateral holding ribs for the wedge-like key;

the lateral regions of the convergent coupling heads have flat transversely extending wings in the immediate vicinity of the disk-receiving slot of the coupling heads;

the elongate scaffold elements that are pushed into mounted position on the free ends of the coupling head extensions are made of light-metal, e.g., aluminum, profiled stock;

with regard to any elongate scaffold elements that do not extend in only a single one of the general x- and y-directions of the erected scaffold, but instead extend diagonally, i.e., in two or more of the x-, y-, and z-directions, these scaffold elements are likewise made of light-metal profiled stock, and the coupling heads used for them are tang-link heads, the flat tangs of which are fabricated by deformation of sheet-steel elements or else are cast or forged steel members, these tang-link heads, at their ends remote from their tangs, being provided with extensions which enter into and engage the interior of such diagonally extending elongate scaffold elements and are held therein by means of inwardly deformed portions of such scaffold elements, these inwardly deformed portions engaging apertures or recesses at the exteriors of the extensions.

Thus, in accordance with the invention, one can employ a combination of light-metal scaffold elements and steel coupling heads, with the coupling heads being reduced as much as possible to become structures constituted by a minimum volume of material but still able to satisfy to the necessary degree the various requirements as to transmission of forces generated within the scaffold structure itself and the various requirements as to ability to absorb, bear and transmit to adjoining scaffold elements the various externally applied forces that are realistically to be expected during scaffold use.

In accordance with one particularly advantageous concept of the invention, mentioned above, the coupling heads have relatively tall radially inward bearing surfaces but, proceeding radially outward from the post against which such a bearing surface is braced, each coupling head undergoes an intelligently conceived dimensional transition down to the diameter, or height, of the associated elongate scaffold element, this dimensional transition most especially affecting the top and bottom boundaries of the coupling head.

According to a very advantageous and important feature of the invention, already mentioned, the top and bottom boundaries of the radially inward bearing surface of each coupling head are differently disposed relative to, e.g., the horizontal median plane of the scaffold pipe that is fastened to the coupling head, or relative to the horizontal median plane of the associated apertured disk. In particular the top and bottom boundaries of this bearing surface exhibit different vertical distances from such median plane. This is connected with the fact that the wedge-like key, after being downwardly pounded into position, engages the periphery of a disk aperture at a point or line or region of engagement, as the case may be, which does not coincide with such median plane but instead is upwardly offset therefrom.

With scaffolds composed in their entirety of steel members, to be in the manner set forth above so exacting and thoughtful as to how one might achieve uniform introduction and distribution of forces externally applied to the scaffold structure was not necessary in the way that is necessary if on seeks to make use of steel coupling heads to join scaffold elements made, not of steel, but of light-metal pipe.

For example, light-metal coupling heads cannot be realized at reasonable cost, for which reason the invention provides a hybrid construction of scaffold elements made of light metal used in conjunction with steel members that have been modified with regard to various structural particulars, and in a spirit of optimization. An already mentioned example of such modification is the fact that the extensions are hollow with interior peripheral walls of truncated-conical shape and inwardly curved transitional regions at their forward portions, as a result of which one is able to employ minimal wall thicknesses, with consequent weight reduction, in regions where high loads are not experienced. In contrast, at the end regions of the scaffold pipes, or the like, at which develop the greatest forces that are to be transmitted from a pipe to a coupling head, greater wall thicknesses are provided. Apart from the structural importance of such a configuration, manufacturing advantages may additionally result. For example, if the coupling head together with its extension is, in fact, a one-piece cast steel member, the just mentioned region of greater wall thickness is, additionally, of advantage during casting and especially when removing the cast piece from its mold.

In the preferred embodiments disclosed herein, the coupling head is configured, at the walls of the key-opening space and in the vicinity of the disk-receiving slot, in a manner to assure, firstly, that the key can be readily held and without possibility of its loss, and that the cross sections required for force transmission are in fact present, and to assure, secondly, that sufficient material is present in the regions of the coupling head that directly neighbor the top and bottom major faces of the apertured disk, in order to prevent transverse tilting of the coupling head relative to the disk especially during conditions of load.

West German Pat. No. DE-PS 24 49 124 already discloses the technique of fastening elongate scaffold elements to coupling heads by pressing such elements onto the heads and then portions of such elements into recesses in the heads. However, such a fastening technique has hardly ever been used in practice, because it is simply more sensible to employ weld connections. However, when using steel coupling heads to connect together pipe or other such elongate profiled stock made, not of steel, but of light metal, that peculiar technique suddenly becomes quite practical, and indeed especially suitable, and makes possible a weight-saving, reliable connection between structural elements of the differing materials in question.

It may well be that one will wish to employ diagonally extending elongate scaffold members, i.e., which extend in two or more of the x-, y-, and z-directions of the usual scaffold geometry. In that event, one can in principle use ones made in customary manner of steel stock, inasmuch as there are generally fewer of these than there are elongate scaffold elements that extend exclusively in a single one of the x- y-directions. However, if one wishes that these diagonal elements, too, contribute to weight saving, one can employ in accordance with a further feature of the invention diagonal elements formed from light-metal profile stock with cooperating tang-link heads, the tang-link heads so designed that they likewise contribute to weight saving while furthermore making possible advantages regarding manufacture and regarding requirements as to force transmission capability. With the tang-link heads and light-metal pipes employed in a preferred embodiment disclosed herein, one can, by way of example, achieve a weight saving on the order of magnitude of 50%, compared to scaffold constructions in which all members are made of steel. This is a very considerable weight saving for applications such as those mentioned earlier, and in general makes the work of scaffold erection crews very substantially easier. Furthermore, one is able to employ the principles of the standard system, i.e., with its apertured disks bilaterally overlapped by coupling heads and its wedge-like keys securing the latter to the former. The ability to apply the concepts of the invention to this standard scaffold system is very advantageous, because the resulting system then assures excellent fastening characteristics but now combined with minimal volume of structural material. Furthermore, such resulting system makes possible reliable taking up of forces applied from differing directions and without danger of loosening of the wedges or the like. These superior characteristics are not so readily realized if one were to employ other coupling designs using cups, double-cups or tabs welded onto the pipe stock and with connecting elements and/or wedges introduced from above.

In this connection, it is also of some importance to adapt the apertured disks to the characteristics of the light metal employed. On the other hand, if one wishes to be able to freely intermix scaffold components of the present invention and standard scaffold components, then one must take into account the dimensions employed in the already existing standardized system. In particular, one must respect and preserve the dimensions of the existing dimensional relationships of the existing standard system, especially at those locations where bearing surfaces, and especially non-planar bearing surfaces, and/or slots are present.

Thus, for example, the apertured disk, if in accordance with the invention made of light metal, per se has very little stiffness, but in accordance with the invention can at a few locations be designed to assure transmission of greater forces. In particular, the apertured disks of prior-art systems, as well as the elements which are to engage the disks, were designed for a disk outer diameter of 122 mm and a disk thickness of 9 mm, these dimensions having proved optimum for a an apertured disk that is made of steel. Without altering the standard size of the disk-receiving slot of the coupling head, but instead by recognizing and then exploiting the possibility of decreasing the play that exists between disk and head, one can in accordance with one concept of the invention provide an apertured disk that is 10 mm thick and has an outer diameter of 124 mm. Clearly, the radius increase amounts to only 1 mm and the thickness increase likewise amounts to only 1 mm, which may seem extremely insignificant as to load capability. Nevertheless, there in fact results a ca. 33% increase in the load-bearing capacity of the apertured disk at the locations thereof that are most critical with respect to the combined effects of shearing and bending stresses, i.e., in general the regions between, on the one hand, the outer corners of disk apertures, especially the larger apertures of the disk, and, on the other hand, the outer margin of the disk itself, these being regions which in general are greatly subjected to shearing stresses; and the regions circumferentially midway of the arcuate webs that are formed between the outer margins of the disk apertures, especially the larger apertures, and the outer margin of the disk itself, these being regions which in general are greatly subjected to bending stresses.

The elongate scaffold elements, in particular the horizontal tie bars and the like when of simple circular-pipe cross section do not, if made of light metal, exhibit sufficient bending resistance at certain locations along their lengths. On the other hand, a closed, annular cross section is of great utility for securing a scaffold element to a coupling head. Therefore, according to a further concept of the invention, the scaffold elements of annular cross section, whether circular pipe stock or other, can be provided with reinforcement at least at their undersides. The underside reinforcement, seen in section, may have the shape of an inverted-T or be box-like. In this way one can enjoy various benefits of the standard connections, e.g. involving circular pipe stock, while yet being able to increase bending resistance as desired, and this while still being able to employ for the scaffold elements economically produced extruded profile stock.

Usually, as to the constituent planking units used to form scaffold platforms, one will provide them with large suspension claws which fit over and engage horizontal tie bars from above and which are provided with automatically dropping mounting elements. However, one may wish instead to employ platform planking units provided with small, hook-like suspension claws. In that event, and in accordance with a further advantageous concept of the invention, one can provide on the elongate scaffold elements transversely spaced legs like the U-profiles anyway employed in such modular scaffold systems, whereupon one can then make use of the standard suspension claws. An especially advantageous configuration is a reinforced elongate scaffold element of pipe-like annular cross section having a downwardly projecting inverted-T profile, because this is easily manufactured and furthermore presents for the designer static-load-bearing behavior that is clearly understood and stiffness behavior that is readily visualized. Further, with that configuration, it is advantageously possible to hang upon the horizontal tie bars the conventional large suspension claws with their mounting fingers.

The novel features which are considered characteristic of the present invention are set forth in detail in the appended claims. The invention itself, however, both as to its construction and its method of assembly, will best be understood from the following description of the presently most preferred embodiments of the invention, when read in connection with the accompanying drawing Figures.

DESCRIPTION OF THE PREFERRED EMBODIMENTS

Figure 1:
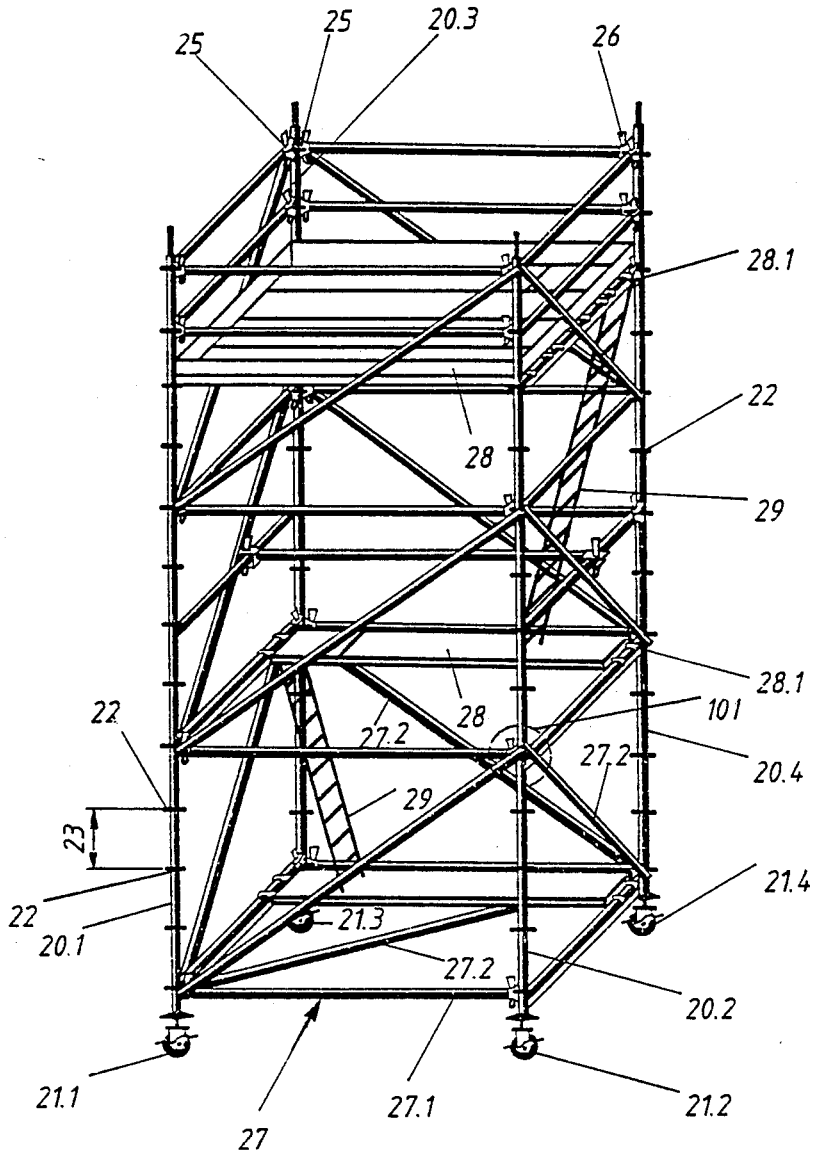
FIG. 1 depicts the particulars and connections of a rolling scaffold tower, in a simplified oblique view.

The scaffold shown in FIG. 1 has four vertical posts 20 which, for purposes of differentiation, are denoted by 20.1, 20.2, 20.3, 20.4, i.e., provided with decimal digits. The posts 20 stand on base rollers 21, similarly differentiated by decimal digits. Each post can consist of several pipes pushed one onto the next and, at suitable intervals 23, is provided with apertured disks 22 which as shown have conventional through-going apertures 24. Coupling heads 25 couple various scaffold elements 27 to the posts 20 and are provided with wedge-shaped keys 26 which pass through the apertures 24 of disks 22. In the present embodiment these scaffold elements 27 include, for example, horizontal tie bars 27.1 and diagonal bars 27.2. The horizontal tie bars extend in one or the other of the x- and y-directions of the scaffold, whereas the diagonal bars extend in two or more of the x-, y-, and z-directions of the scaffold.

Planking units 28 form, as shown, the top platform of the scaffold, and can likewise be used to form intermediate platforms, helpful when climbing the scaffold in conventional manner using ladders 29. As conventional, the planking units 28 have claws 28.1 which hook over the horizontal tie bars and are provided with automatically acting safety fingers which grip the tie bars from below.

The posts 20 are made of light metal of a wall thickness 31 of 4 mm and an outer diameter 32 of 48.3 mm (i.e., a radius 47 of ca. 24 mm) such as conventional for such modular scaffolds, and accordingly can also be used with scaffold elements from standard scaffold systems, such as connection-effecting couplings and the like.

Figure 3:
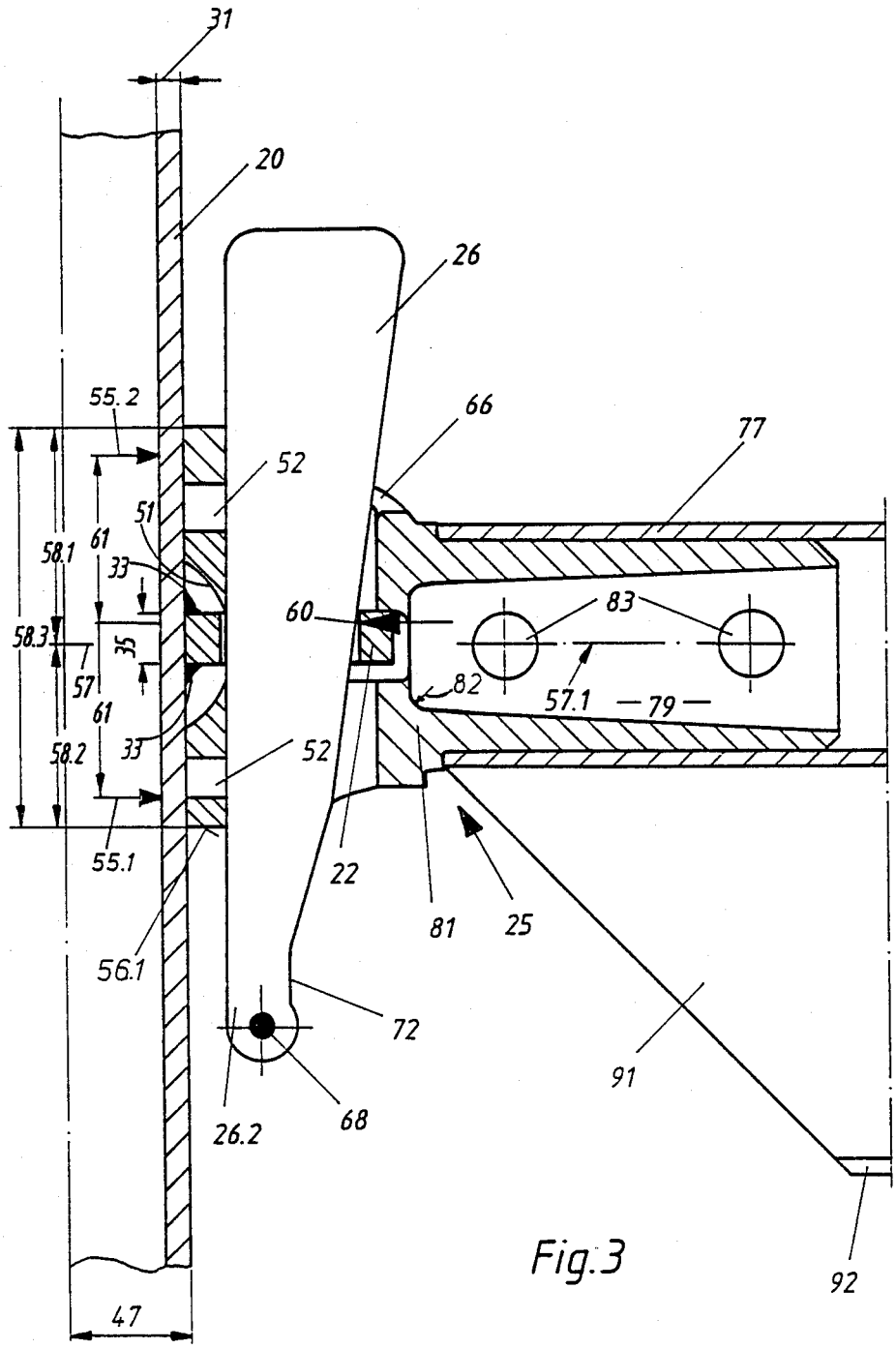
FIG. 3 is a vertical section taken along line 3—3 of FIG. 2, on a larger scale.
Figure 4:
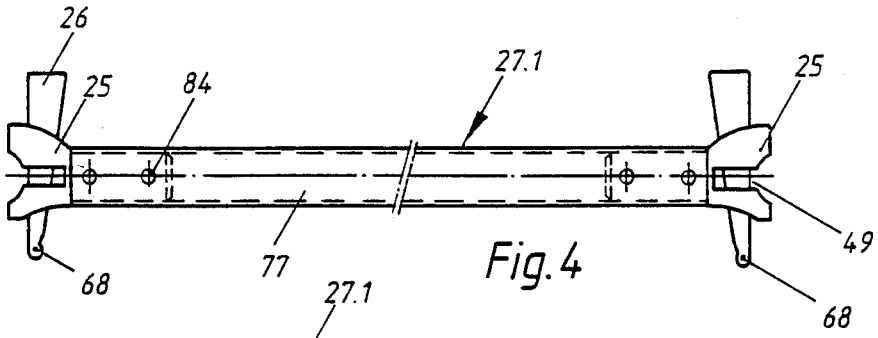
FIG. 4 is a smaller-scale side view of a horizontal tie bar joined at each end to a respective one of two coupling heads.
Figure 5:
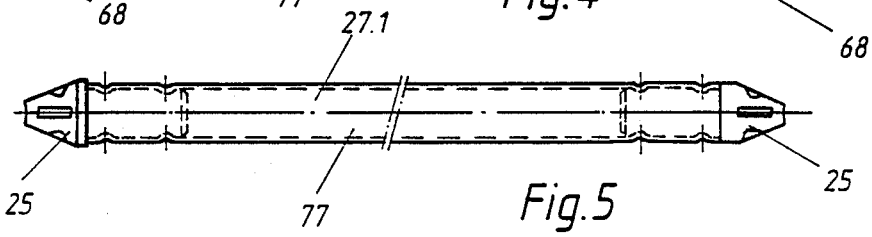
FIG. 5 is a top view, looking down upon the tie bar of FIG. 4, but with the wedge-like keys of the two coupling heads omitted.

The apertured disks 22 are made of light metal. In the illustrated modular system, the disks are rigidly welded at intervals 23 to the constituent round pipes of posts 20, in each instance by means of two weld seams 33 (FIG. 3). The disks 22 have an outer diameter 34 of 124 mm and a thickness 35 of 10 mm. The distance 42 (FIG. 10) between the planar key-engaging wall 36 of each smaller disk aperture 24.1 and the central axis 37 common to a particular post 20 and the associated disk 22 amounts to 50 mm. This distance is equal to the radius 39 of the cylindrical key-engaging walls 38 of the larger disk apertures 24.2 (FIG. 10) that are used when connecting on diagonally extending scaffold elements. Compared to conventional apertured disks the disk radius is greater by 1 mm and the disk thickness greater by 1 mm. This affects the larger apertures 24.2 of disk 22, by correspondingly increasing the cross section of material present both at the region of the aperture corner 41 where shearing stresses develop and also at the middle region of the arcuate web 43 where bending stresses develop, resulting, in a ca. 33% total increase of the possible loading compared to an aluminum disk of standard dimensions, having a 122 mm diameter and a 9 mm thickness. The usual tolerances are so great that—if desired—the pipe couplings conventionally used in steel-pipe scaffolds of standard dimensions can be pushed onto and secured to the somewhat enlarged disk, i.e., without departure from such standard dimensions. This is of great importance when improving upon a modular system that has already achieved very wide use; indeed, in such circumstances, one would in principle be quite willing to consider the use of unconventional techniques, if only not to depart from such standard dimensions.

Figure 6:
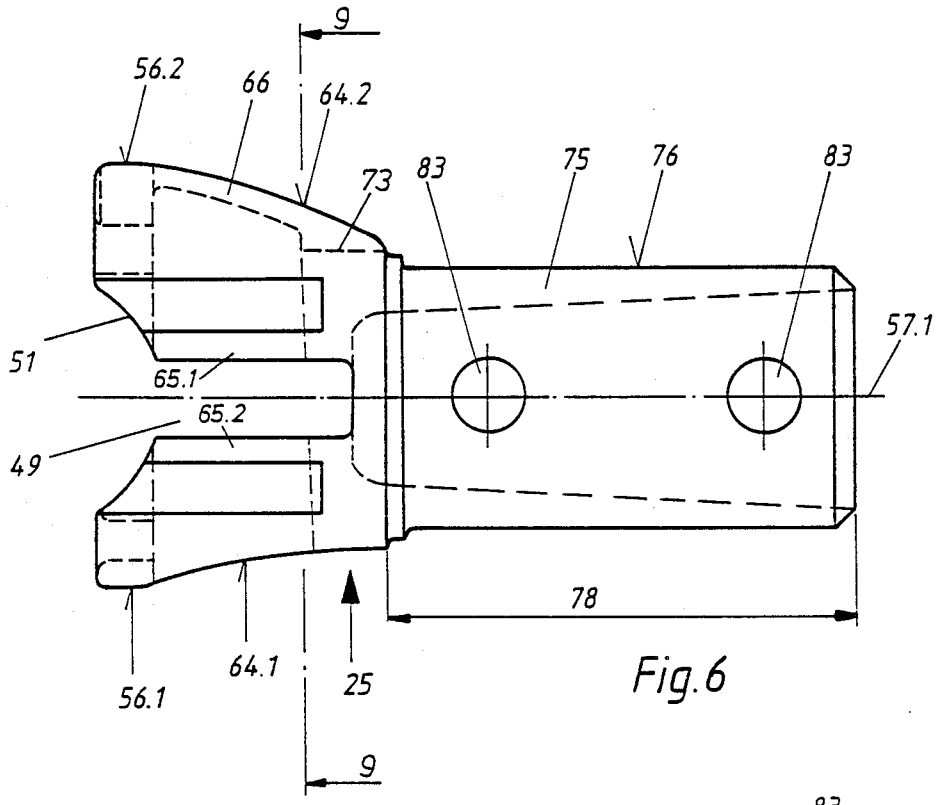
FIG. 6 is a side view of a coupling head, shown at approximately a real-life, 1:1 scale.
Figure 7:
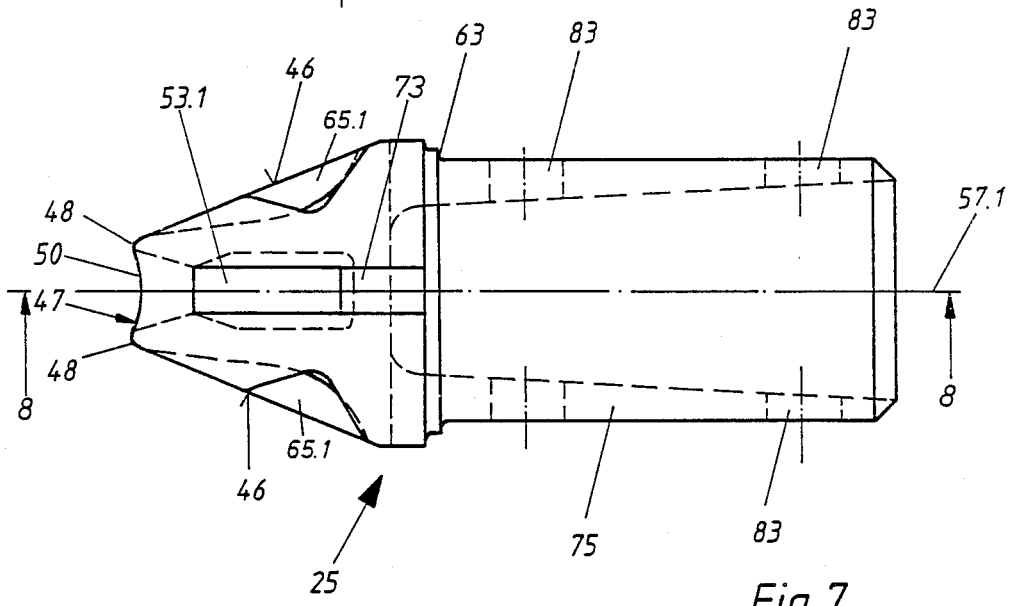
FIG. 7 is a top view looking down upon the coupling head as shown in FIG. 6.
Figure 11:
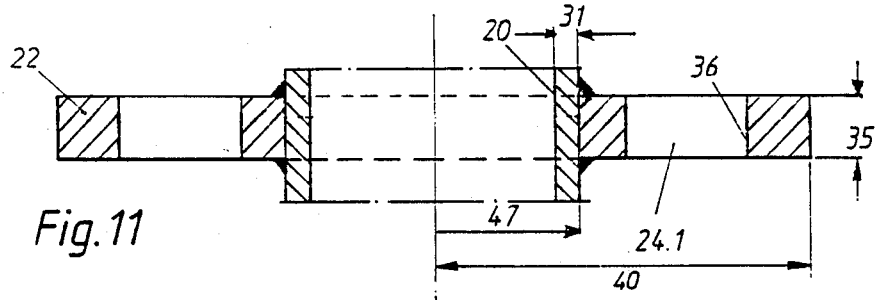
FIG. 11 is a vertical, axial section through the apertured disk of FIG. 10, also showing an associated interval of the vertical scaffold post.

The coupling heads 25 and 105 are, generally considered, of standard configuration, which is also advantageous because of the resulting possibility of using them in the context of existing modular systems. The lateral boundaries 46 (see FIGS. 2 and 7) of the coupling heads are convergent towards the common axis of the associated post 20 and disk 22. As a result, the coupling head 25 or 105 can be coupled to the apertured disk 22 at any of eight different directions of radial approach to the post axis, i.e., can be coupled to any of the four smaller and four larger disk apertures 24.1, 24.2 (FIG. 10). The radially inward facing contact face 50 (see FIG. 7) of the coupling head 25 or 105 is concave with a curvature radius 47 of 24 mm, equal to the outer radius 47 (see FIG. 11) of the post 20. The lateral edges 48 (see FIG. 7) are transversely rounded, to form smooth transitions from the bearing face 50 into each of the lateral boundaries 46. In this way there are no sharp edges at 48 to dig into the material of the outer wall surface of the respective post 20 and undesirably form an accumulation of indentations. This is particularly important when the post 20 is made of light-metal pipe stock. The coupling heads 25 are provided with customary horizontal slots 49 (see FIGS. 9, and 6 and 8) 12 mm in height. Concavely rounded, lower and upper corner portions 51 (see FIG. 8) form transitions from the lower and upper regions of the horizontal slot 49 to the radially inward facing concave bearing face 50 (FIG. 7). The bearing face 50 is thereby interrupted and subdivided into lower and upper bearing surface portions 50.1, 50.2 (FIG. 8) which bilaterally adjoin the faces of the cooperating apertured disk 22 on a particular post 20. These two bearing surface portions 50.1, 50.2 have respective through-openings 52 (see e.g. FIGS. 8 and 9) which extend all the way into the key-accommodating space formed by the key-receiving openings 53.1, 53.2 (see e.g. FIGS. 8 and 9). In this way, the bearing surface portions 50.1, 50.2 that brace the coupling head against post 20 are decreased to become arcuate-annular surfaces of rectangular section of the dimension needed to effect sufficient bracing under load, the arrows 55.1 and 55.2 (FIG. 3) roughly indicating the locations of the resultants of the forces applied to such surfaces when under load.

Figure 8:
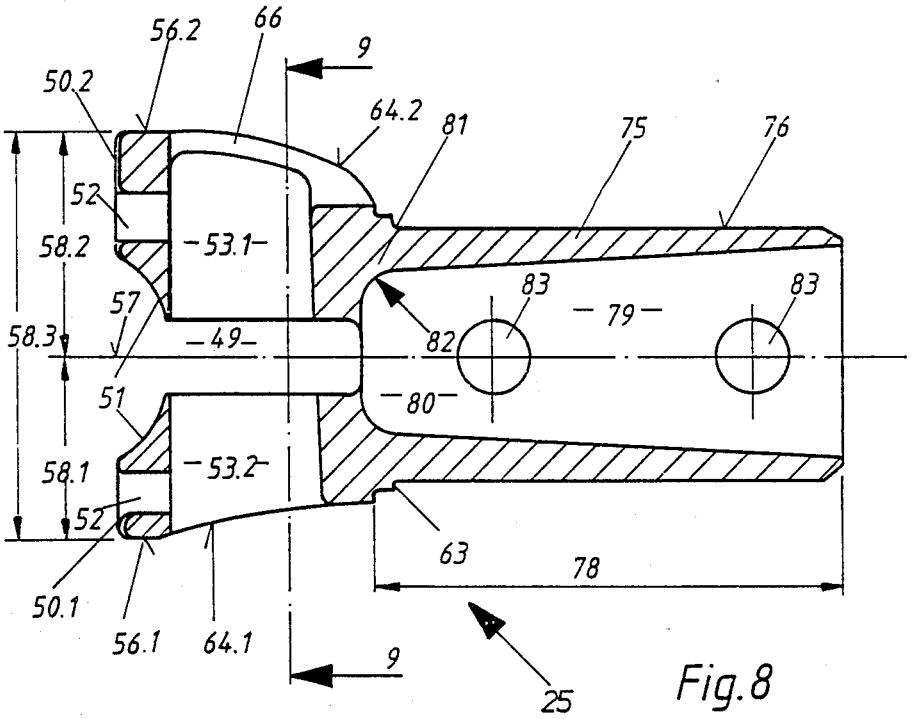
FIG. 8 is a vertical section taken along line 8—8 of FIG. 7.

As indicated in FIG. 8, the heights of the radially inward facing bearing surface portions differ. The outer lower limit 56.1 is located a distance 58.1 downwardly from the horizontal median plane 57 of slit 49, whereas the outer upper limit 56.2 (FIG. 8) is upwardly spaced a distance 58.2 from horizontal median plane 57. In this regard, dimension 58.1 preferably amounts to 30 mm and dimension 58.2 to 36 mm, resulting in a total height 58.3 of 66 mm, the midpoint of which is upwardly displaced by 3 mm relative to horizontal median plane 57. Accordingly, roughly equal distances 61 obtain between, on the one hand, the location 60 (FIG. 3) where the sloping side of wedge-like key 26 is braced against the radially outer edge of an aperture 24 of disk 22 and, on the other hand, the locations (indicated by the aforementioned arrows 55.1 and 55.2) at which, when the coupling head 25 or 105 is under load, the resultants of the forces exerted upon the coupling head and apertured disk 22 are effectively applied. In this way, when the coupling head is under load, the torque exerted upon the post and the coupling head will be exerted through a lever arm of the same length, no matter whether the torque is exerted upward or downward, and the bracing forces which the post and coupling head must provide will accordingly likewise be roughly equal for both the case of upward and the case of downward loading. These loads are in the first place variable, and in the second place alternating. Furthermore, the connection between the coupling head and post is not an articulate or hinged connection; neither is it a rigid one. Instead, the connection is a relatively elastic one, effective in a plurality of planes, and it furthermore includes the effect of prestress forces present even in the absence of load. Accordingly, when selecting appropriate dimensions, the designer will generally wish to proceed to some extent empirically, relying to a considerable degree upon experience, tests, and in part upon calculations performed upon experimental models, in order to find the configurations that ar optimal for particular intended fields of use. The aforementioned dimensions satisfy such requirements outstandingly for the case of a coupling head 25 made of cast steel, or perhaps forged steel, used with posts constituted by light-metal pipe.

The forward bearing surface 50 of the coupling head 25 is generally speaking of elongate rectangular shape (for example when viewed in FIG. 7 from the left along a line of sight coinciding with axis 57.1). In contrast, at its rear the coupling head 25 has a rear bearing end face 63 advantageously delimited by a circle corresponding to the outer diameter of the pipes of the scaffold system, in the present instance a diameter of ca. 48 mm. The already mentioned lateral boundaries 46 (e.g. FIG. 7) extend toward the bearing end face 63 divergently, in a wedge-like manner if viewed e.g. as in FIG. 7. In the illustrated embodiment, the top and bottom boundaries 64.1 and 64.2 (FIGS. 6 and 8) are of slightly rounded shape, so that the height of the coupling head (as viewed in e.g. FIG. 8), gradually decreases, proceeding rearward, to a value corresponding to the height or diameter, as the case may be, of the scaffold element to be coupled (e.g., in FIG. 3, gradually decreases to a value corresponding to the diameter of tubular scaffold element 77). The bottom boundary 64.1 is of somewhat concavely domed shape, whereas the top boundary 64.2 is of somewhat convexly domed shape. Abstractly, this relationship could be reversed but, practically, is of greater advantage for the secure holding of the key 26. The key 26 is, roughly speaking, straight but wider at its upper part (see FIG. 3), and when inserted is driven downward to extend parallel to post 20. Thus, the fact that it is top boundary 64.1, not lower one 64.2, that is convexly domed creates a greater area of surface engagement between, on the one hand, the key 26 and, on the other hand, the two holding ribs 66 (see first FIG. 9, then FIG. 8, then again FIG. 3).

Figure 2:
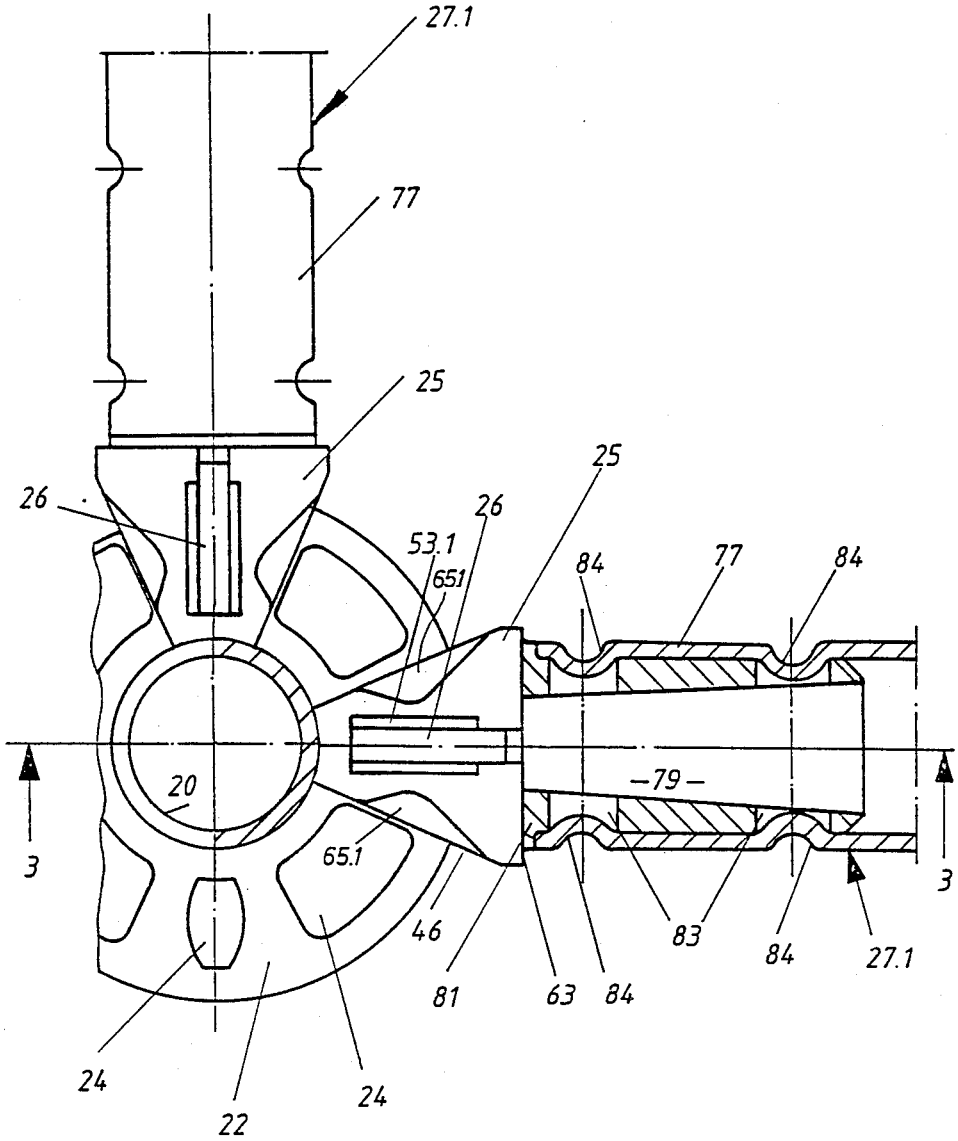
FIG. 2 is a horizontal section through a vertical post of the FIG. 1 scaffold, with top-view depiction of one apertured disk and two coupling heads joined to the disk by wedge-like keys, each coupling head joining to the disk an associated pipe-like scaffold element of which one is shown in horizontal section.

Flat, horizontal, laterally projecting, upper and lower wings 65.1, 65.2 (see FIG. 9) bound the aforementioned slot 49 from above and from below, respectively. In FIGS. 2 and 7, the upper horizontal wing 65.1 can be seen from above, and in FIG. 6 both the upper and lower wings 65.1, 65.2 can be seen laterally. The earlier mentioned boundaries 46 (e.g. FIG. 7) thus form, in particular, the lateral boundaries of the laterally projecting wings 65.1, 65.2. These wings have a vertical thickness of, e.g., about 5 mm. In addition to bounding slot 49 from above and below, these wings (as clearest from FIG. 2) impart to the coupling head 25 a substantial transverse width, namely at the particular height where the head engages the top and bottom major faces of disk 22, and thereby impart to the head a considerable ability to resist any forces that would tend to cause rotation of head 25 about axis 57.1 (FIG. 7).

Figure 9:
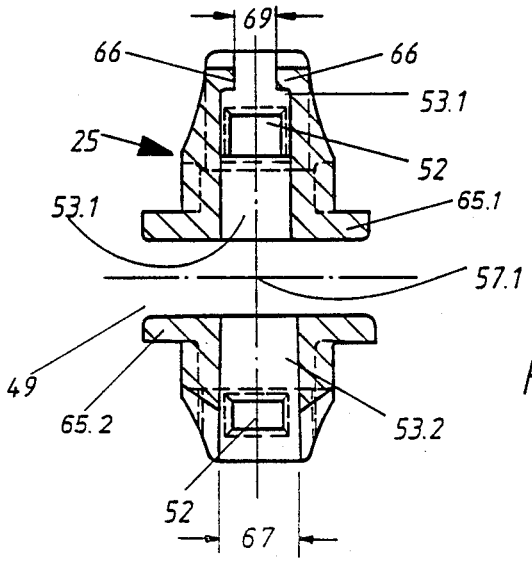
FIG. 9 is a vertical section taken along line 9—9 of FIG. 6.
Figure 10:
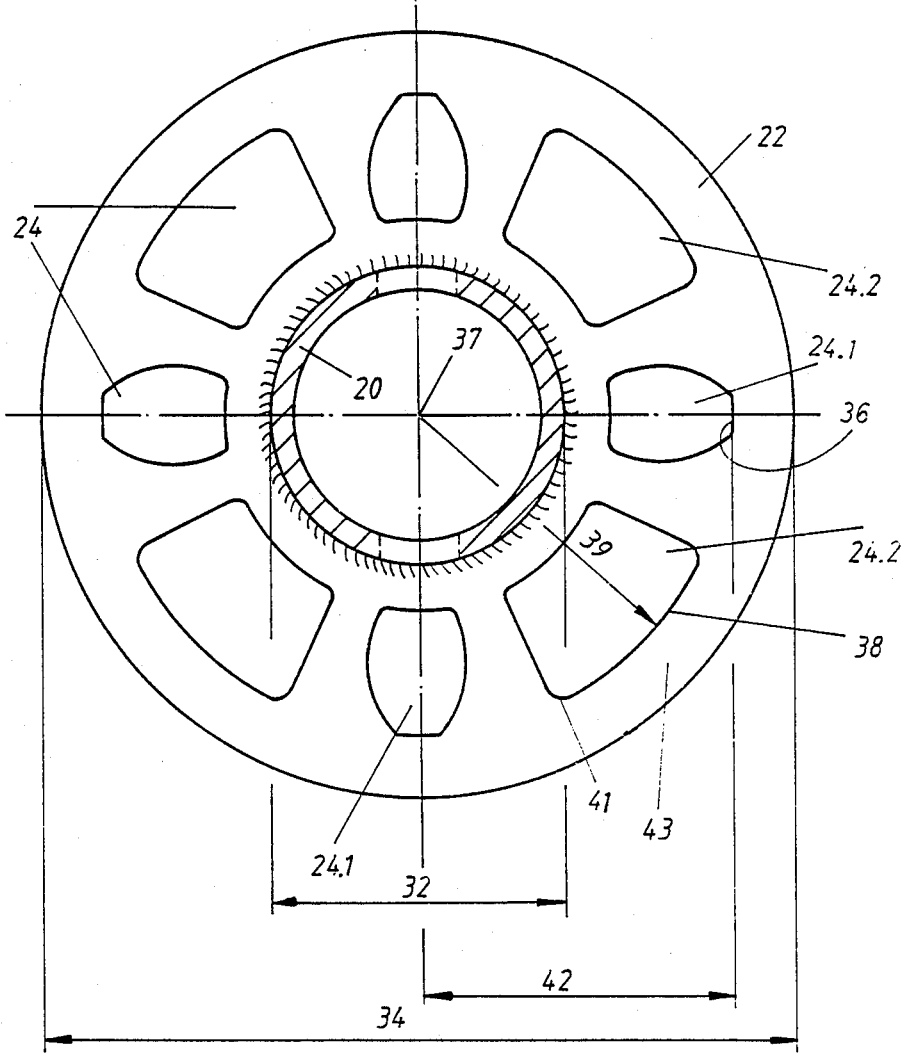
FIG. 10 is a top view of an apertured disk mounted on a vertical scaffold post, the post shown in horizontal section.

The key-receiving openings 53.1, 53.2 extend through the coupling head 25 perpendicular to the slot 49 (as best seen in FIG. 9) and, except at the region of the holding ribs 66, are of a breadth 67. Breadth 67 somewhat exceeds the length of the loss-prevention rivet 68 (FIG. 3) provided at the bottom end of key 26. Intermediate the two holding ribs 66 (see FIG. 9) the upper key-receiving opening 53.1 has a breadth 69. Breadth 69 is greater than the thickness of key 26 but smaller than the length of loss-prevention rivet 68. As a result of these relationships, one is readily able to shift key 26 up and down, and in particular shift it up a distance such that its bottom end can be raised to a height above slot 49, and thus above the top major face of disk 22. In this way one can upwardly withdraw the key 26 from the one of the eight disk apertures 24 in which it is presently inserted, and then horizontally swing the coupling head 25 in one or the other direction, and then shift the key 26 down, to become inserted into a different one of the eight apertures 24. On the other hand, the key 26 cannot be upwardly shifted so great a distance as to become entirely withdrawn from the upper key-receiving opening 53.1. Furthermore, the right edge of key 26 (as viewed in FIG. 3) is (downwardly proceeding) straight for a considerable distance, i.e., downwardly and forwardly inclined, then proceeds further down with a greater forward incline, and then exhibits a vertical interval 72 of still narrower left-to-right dimension (as considered in FIG. 3), the region of this vertical interval 72 at the bottom end 26.2 of key 26 constituting an edge recess. When one pulls key 26 vertically upward substantially as far as it will go, one can then swing key 26 down (clockwise as viewed in FIG. 3), and the presence of the edge recess 72 will permit the key to assume a generally horizontal orientation in which it extends generally parallel to the associated scaffold element, e.g., generally parallel to the elongation of the tubular scaffold element 77 shown in FIG. 3. In the illustrated embodiment, the ability of the key 26 to assume such an orientation is supplemented by the provision of a recess 73 provided at the top boundary 64.2 of coupling head 25. The longitudinal and transverse dimensions of recess 73 are most clearly seen in the FIG. 7 top view. The vertical dimension of recess 73 is most clearly seen in the FIG. 6 side view, in which the bottom of recess 73 is indicated in broken lines. The ability of key 26 to be in this way folded down into a generally horizontal orientation can facilitate transport of the scaffold, e.g., partial or substantial folding or collapse of the scaffold (in e.g. partially dismantled state) for purposes of transport. Also, if the coupling head is presently associated with one disk aperture 24 but is then to be associated with a different aperture 24, the key 26, when in the orientation just described, is conveniently out of the way and requires no particular attention, e.g., no holding of it by hand to prevent it from dropping into and through an undesired one of the disk apertures 24. In the vicinity of the holding ribs 26 there can furthermore be exteriorly provided small reinforcements of a shape providing sufficient cross sections for the forces that develop and are to be transmitted, while avoiding superfluous, weight-increasing accumulations of material, e.g. by providing suitable recesses between such reinforcements and the wings 65.

The coupling heads, with respect to the parts thereof described up to this point, can be used to connect to the posts both scaffold elements that are to extend in the axial direction of a coupling head and scaffold elements that are to extend at an angle to such axial direction.

For use in connecting elongate scaffold elements which are to have an orientation in the direction of axis 57.1, then in the manner shown in FIGS. 3–9 the coupling heads 25 are provided with extensions 75 which can be integral extensions, i.e., of one piece with the coupling heads. Exteriorly, these extensions 75 have cylindrical, or approximately cylindrical, insert surfaces 76 onto which one or another scaffold element can be pushed into position, such scaffold element being here, by way of example, a cylindrical pipe 77 of a horizontal tie beam 27.

The elongation of the extensions 75 corresponds to that needed or desired for the scaffold elements to be mounted. The extensions 75 have internal chambers 79 which are (FIGS. 6–8) configured somewhat conically, having a diameter which decreases toward the forwardly located coupling head 25. The forward end region 80 of each such internal chamber 79 communicates with, i.e. opens into, the slot 49, exhibiting a transitional region 81 of curvature radius 82. As seen clearly in FIG. 8, this transitional region 81 adjoins the rear end of coupling head 25. Because the conical peripheral surface of chamber 79 curves radially inward in this way before intersecting the end face of chamber 79, the transitional region 81 is possessed of a greater volume of material than in the absence of such transitional region. As a result, the transitional region 81 constitutes a reinforcement of the general location at which the extension 75 and the head 25 meet, of sufficient volume of material and cross-sectional area to withstand and transmit loads at highly or maximally loaded locations on the scaffold structure. Furthermore, one has devised a configuration which, as set forth in greater detail below, is advantageous in substantially the same manner in the event that diagonally extending bars or other such scaffold elements are to be connected, i.e., one being able still to use the same head configuration. Fastening apertures 83 (FIG. 7), here four in number, transversely extend through the walls of the extensions 75. During assembly, an e.g. pipe-shaped scaffold element 77 is forcibly pushed and pressed onto the extension 75, and deformed generally hemispherical fastening indentations 84 become pressed into the fastening apertures 83. The cooperating indentations 84 and apertures 83 prevent rotation of element 77 relative to extension 75, and resist pulling of element 77 longitudinally off from extension 75. Accordingly, a secure connection can be established between a pipe-shaped scaffold element 77 of extruded, profiled, light-metal stock and a coupling head 25 made of cast steel, to produce in accordance with this embodiment of the invention a permanently assembled scaffold structure of optimal configuration, nevertheless of low weight, able reliably to transmit and bear the forces that will be encountered during use, and doing all this with an extremely high degree of safety and reliability although requiring a minimum amount of structural material. Furthermore, the resulting structure takes into account the characteristics of, and requirements placed upon, advantageous coupling techniques involving key-receiving, apertured disks used in conjunction with coupling structures directly braced against a post bilaterally of a respective apertured disk. In particular, for the elongate structural elements, such as tie bars and the like, which are the elements of the scaffold that consume the major part of the necessary volume of structural material, extruded profiled stock made of light metal can be employed. In contrast, at the highly stressed locations, structural elements made of steel are employed, these being of comparatively small cross section and optimized with regard to their shape. If thin disks are to be secured on the pipes in a manner that is economical, this can be done only by means of welding. Light-metal apertured disks are employed having dimensions which, in the context of the modular system, were chosen for a load capability corresponding even to the case of tower-like scaffolds, and the like, erected to heights in excess of 12 meters, this presuming that one does not desire capability for extremely high total loads, to be borne by the scaffold structure as a whole, i.e., loads such as are seldom to be reckoned with in practice.

Figure 12:
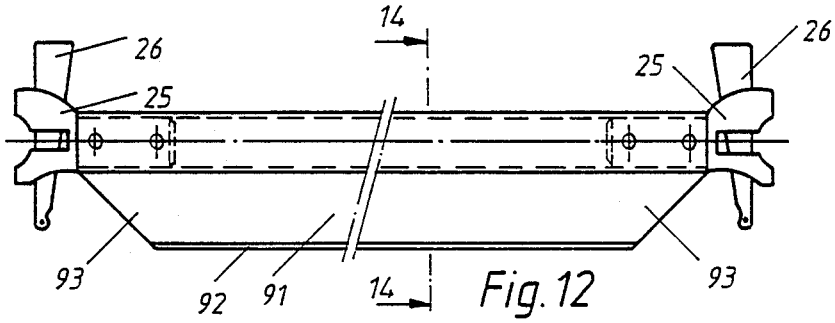
FIG. 12 is a side view of a pipe-like scaffold element provided with a downwardly extending, inverted-T reinforcement.
Figure 13:
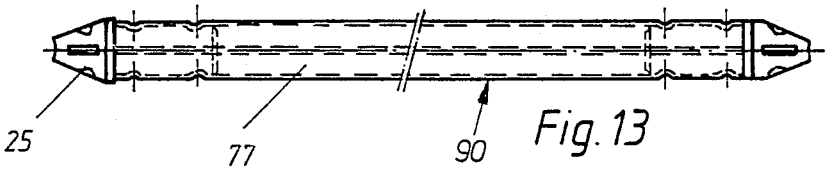
FIG. 13 is a top view looking down upon the scaffold element of FIG. 12, but omitting the wedge-like keys shown in FIG. 12.
Figure 14:
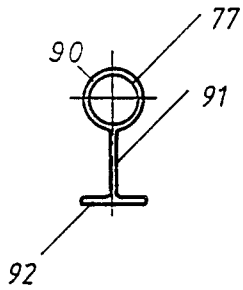
FIG. 14 a cross section taken along line 14—14 of FIG. 12, omitting the coupling head and key.
Figure 15:
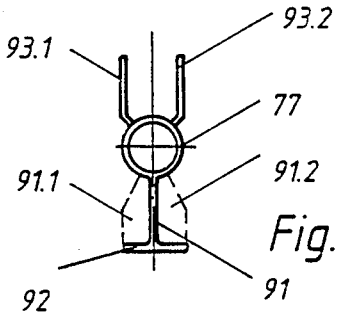
FIG. 15 is a cross section analogous to FIG. 14, illustrating thereof.

The elongate scaffold elements 27, especially the horizontal tie rods, directly carry the claws 28.1 (FIG. 1) of the scaffold platform planking. As a result, considerable bending stresses are applied to the elements 27. When using thin-walled, light-metal, pipe-like scaffold elements 27, under certain circumstances these cannot reliably withstand these loads, for example if slight overloading should furthermore occur. FIGS. 12–14 depict an advantageous modification which can be useful for such situations. Elongate scaffold elements 90, preferably of round pipe stock, are provided with reinforcements, especially at their undersides. As shown in FIGS. 12–14, one can make use of a bottom reinforcement of inverted-T profile (FIG. 14) including a web 91 and a midway located flange 92. Each such bottom reinforcement can be configured to exhibit, e.g., a 45°-inclined cut-away at its two ends (FIG. 12). The total height of each bottom reinforcement can for example be 110 mm, the transverse flange breadth about 42 mm, the pipe-like portion of the scaffold element having an outer diameter of 42.3 mm and a wall thickness of 2.8 mm. With such pipe configurations, the securing fingers of the claws 28.1 can then hook onto the pipe 77 beneath the horizontal median plane of the pipe 77 without interference from the web 91, so that one can still employ automatic mechanisms that prevent planking units from accidentally lifting up and becoming detached at one or the other end. If one desires still greater reinforcement, or indeed even stiffness for wind resistance, the bottom reinforcement can instead be of box-like profile having two webs 91.1, 91.2 (indicated merely schematically in the lower half of FIG. 15) and being provided with a through-going flange 92.

It may be that one wishes to use for the scaffold platforms constituent plank units having customary U-profile claws which engage the horizontally extending elongate scaffold elements from above, and which bear down upon them from above. In that event, one can provide U-profiles of corresponding configuration suitably attached to the coupling heads 25. However, in accordance with a different, and advantageous, second alternative (see upper half of FIG. 15), one can provide legs or flanges 93.1, 93.2 attached to the upper part of the round pipes 77, these being spaced from each other a distance corresponding to the configurations and dimensions of the aforesaid claws. These legs or flanges 93.1, 93.2 can have a height of about 40 mm and a spacing of about 40 mm. These can be used alone, or in combination with the already described reinforcements at the underside of the pipes 77.

For the connection of diagonal pipes onto the apertured disks 22 it is usual to provide coupling heads with rotary pivot pins that, in correspondence to the available possibilities for diagonal directions, are secured on the disks with keys in the usual manner, and with the diagonal bars having tang links. Such basically known connections are developed in inventive manner for a light-metal/steel construction in FIGS. 16–20.

Figure 16:
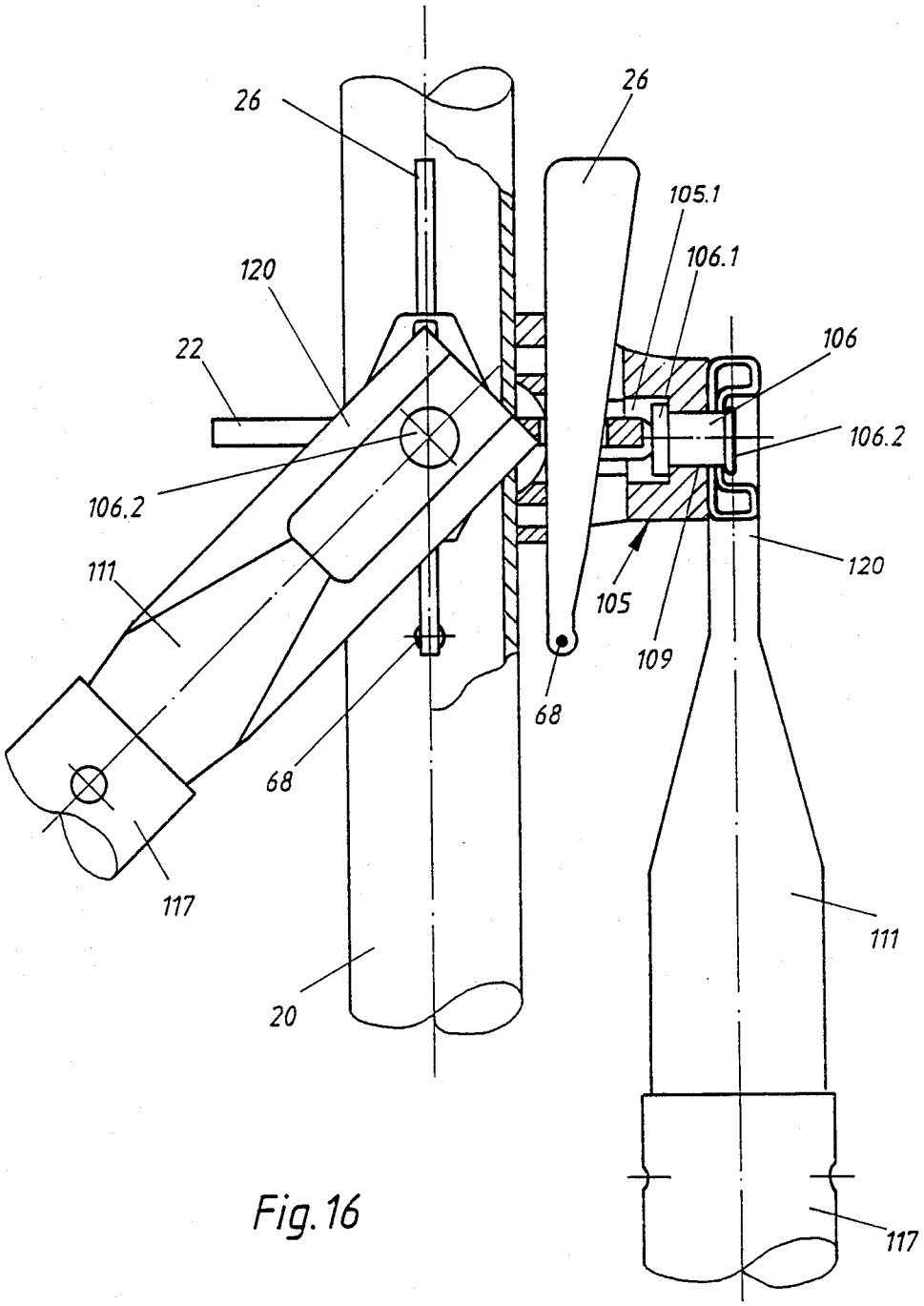
FIG. 16 is a side view of a corner connection involving two diagonally extending pipe-like scaffold elements, one parallel to the picture plane and the other occupying a plane normal to the picture plane, further involving two coupling heads like those in the preceding Figures coupled to the apertured disk, and yet further involving two tang-link heads connecting the pipe-like scaffold elements to respective ones of the two coupling heads, the illustrated structure being shown partly sectioned along a vertical section plane that passes through the center axis of one of the coupling heads.
Figure 20:
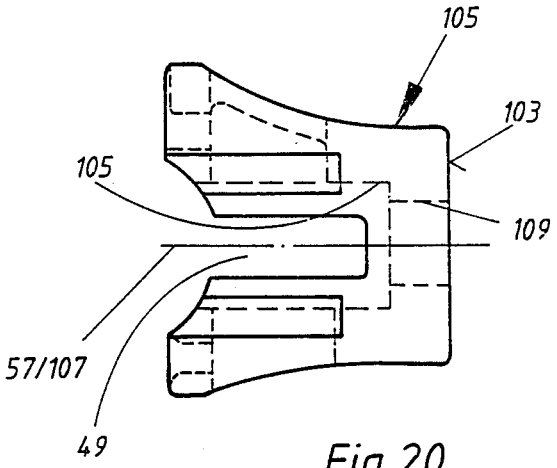
FIG. 20 is a side view of a coupling head used for articulate connection of a diagonal scaffold element.

FIG. 16 depicts an apertured disk 22 on a post 20, at a junction similar to the front right scaffold corner indicated by 101 in FIG. 1, but omitting the horizontal tie bars that are present at the corner 101 of FIG. 1. The two shown coupling heads 105 at their forward portions are of the configuration already described with regard to FIGS. 2–3 and 6–9 and are secured to the shown apertured disk 22 by means of the same wedge-like keys 26. The coupling heads 105 have planar, annular end faces 103 (FIG. 20). Each coupling head 105 is furthermore provided with a rotary pivot member 106 (best seen in FIG. 16) mounted in such a position that its axis coincides with the horizontal median plane 57 or central axis 107 (FIG. 20). Each rotary pivot member 106 has, at its forward end an enlarged-diameter stop head 106.1 which is accommodated in a recess 105.1 of the coupling head. Rotary pivot member 106 extends through the opening 109 of a tang-link head 110 and, in per se conventional manner, is secured in position by a rivet end or ridge 106.2.

Here, however, there is chosen for the tang-link head 110 a configuration that can be produced from steel pipe stock. In particular, the tang-link head 110 is produced by deformation of thin-walled sheet-steel pipe. The tang-link head 110 at its rear includes a male or insert portion 111 having a cylindrical external surface 112 onto which a light-metal pipe 117 can be pushed into mounted position. The walls of the male or insert portion 111 of head 110 are provided with apertures 113 (see FIG. 18). When light-metal pipe member 117 is pushed into mounted position on male portion 111 of head 110, hemispherical indentations provided on pipe member 117 engage the apertures 113 in the same way that, in FIG. 2, the pipe indentations 84 engage the pipe wall apertures 83, thereby securing the pipe member 117 in mounted position on the male portion 11 of head 110. The forward, free, coupling portion 120 of tang-type coupling head 110 is worked to form a generally flat-rectangle tang (FIG. 19) having a height 118 of about 15 mm, which then is compressed at its transversely intermediate interval to form the shown intermediate recess 119 (see also FIG. 18), such as customary for the diagonally extending steel-pipe scaffold elements of scaffold structures. Recess 119 accommodates the ridged end 106.2 of rotary pivot member 106 (see FIG. 16). A pivot-mounting bore 121 (FIGS. 18, 19) located at the compressed-together intermediate region of the generally rectangular tang rotatably mounts (FIG. 16) the main body portion of rotary pivot member 106. In this way, without departing from the basic principles of conventional systems of the type that involve steel coupling heads and metal-pipe scaffold elements that are pushed onto the coupling heads and secured thereon by means of deformation, one nevertheless has created a construction which, firstly, is compatible with such conventional systems and which, secondly, permits the use of diagonally extending scaffold elements made of light metal and further permits the use of the material- and weight-saving coupling heads described further above. Thus, as a result, one achieves a sufficiently stiff scaffold construction that is lighter in weight, not merely due to the lighter weight of the scaffold elements that extend horizontally in a single one of the x- and y-directions, but additionally lighter in weight due to the use of lighter-weight material for the scaffold elements that extend in two or more of the x-, y- and z-directions.

Without further analysis, the foregoing will so fully describe the basic concepts of the invention that others can, by applying current knowledge, readily adapt it for various applications without omitting features that, from the standpoint of prior art, fairly constitute essential characteristics of the invention.

While the invention has been disclosed with regard to specific embodiments that are at the present time deemed most preferred ones, it will be clear that various modifications can be made without departing from the spirit of the present invention.

What is deemed new and patentable is set forth in the appended claims.

I claim:

1. An improved scaffold system of the type which comprises:

vertical posts (20), horizontally oriented annular apertured disks (22) secured to the vertical posts (20) and spaced along the lengths of the posts (20) at intervals corresponding to a grid pattern to be formed for the scaffold system, the apertured disks (22) having a circumferential succession of key-receiving apertures (24.1, 24.2, FIG. 10), the apertured disks (22) and the respective posts (22) to which they are secured sharing common center axes (37, FIG. 10), coupling heads (25, FIGS. 2–9, 12–13; 105, FIGS. 16–17, 20) made of cast or forged steel, wedge-like keys (26) for securing the coupling heads (25; 105) to respective apertured disks (22), wherein the coupling heads (25; 105) have horizontal disk-receiving slots (49, FIGS. 8–9) located intermediate the top (56.2, 64.2, FIG. 8) and bottom (56.1, 64.1) boundaries of the coupling heads (25; 105), so that a coupling head (25; 105) can be pushed onto, and thereby be mounted on, an apertured disk (22) in such a manner (cf. FIG. 3) that the apertured disk (22) enters the disk-receiving slot (49, e.g. FIG. 8) of the coupling head (25; 105) with the top and bottom faces of the disk (22) thereby engaged by the coupling head (25; 105), wherein the coupling heads (25; 105) furthermore have part-cylindrical, radially inward bearing surfaces (50, FIG. 7) of a radius equal to the outer peripheral radius of the posts (20, cf. FIG. 2) the radially inward bearing surfaces (50) bearing radially inward against a respective post (20) in surface-to-surface contact therewith (FIG. 2) when the coupling head (25; 105) is pushed onto an associated apertured disk (22), the radially inward bearing surfaces (50) of a coupling head (25; 105) including a top bearing surface (50.2, FIG. 8) located above and a bottom bearing surface (50.1, FIG. 8) located below the horizontal disk-receiving slot (49) of the coupling head (25; 105), wherein the coupling heads (25; 105) have convergent lateral boundaries (46, 46, FIG. 7) each of which extends in the direction toward the common center axes (37, FIG. 10) of the associated posts (20) and apertured disks (22), wherein the coupling heads (25; 105) have key-receiving spaces formed by paired key-receiving openings (53.1, 53.2, FIG. 8), the top opening (53.1, FIGS. 8–9) being located above and the bottom opening (53.2, FIGS. 8–9) below the disk-receiving slot (49, FIGS. 8–9) of the respective coupling head (25; 105), wherein the keys (26, FIG. 3) each extend down through the top key-receiving opening (53.1) of a respective coupling head (25; 105), then down through one of the apertures (24.1, FIG. 11) of an associated apertured disk (22) when the coupling head (25; 105) is in mounted position (FIG. 3) on such disk (22), and then finally down through the bottom key-receiving opening (53.2) of the respective coupling head (25; 105), wherein the keys (26, FIG. 3) are each wedged (60, FIG. 3) between the radially outer margin (36, FIG. 11) of a disk aperture (24.1) and a radially inward surface of the key-receiving space (53.1, 53.2, FIG. 8) of a respective coupling head (25; 108), wherein the bottom key-receiving openings (53.2, FIG. 8) are transversely broader (67, FIG. 9) than at (69, FIG. 9) the upper end regions of the top key-receiving openings (53.1, FIG. 8) and the keys (26, FIG. 3) are provided at their bottoms (26.2) with transversely thickened portions (68, FIG. 3) that prevent the keys (26) from becoming lost as a result of upward removal of the keys (26) from out between the upper end (69, FIG. 9) regions of the top key-receiving openings (53.1, FIGS. 8–9), wherein the scaffold system furthermore includes horizontal and/or diagonal elongate scaffold elements (77, FIG. 2; 117, FIG. 16) which are fastened to respective annular apertured disks (22) through the intermediary of respective coupling heads (25; 105), wherein the coupling heads (25) that connect horizontal elongate scaffold elements (77) are provided with extensions (75, FIGS. 6–8) which extend into and engage the interiors of such horizontal elongate scaffold elements (77, FIG. 2), these extensions (75) having recesses (83, FIG. 2) or apertures (83), and the horizontal elongate scaffold elements (77) have deformed regions (84, FIG. 2) which are received in such recesses (83) or apertures (83) or else are provided with fastening elements which extend through such apertures (83), and wherein the coupling heads (105, FIG. 16) that connect diagonal elongate scaffold elements (117, FIG. 16) are provided with rotary pivot members (106), and the diagonal elongate scaffold elements (117) are provided at their ends with flat tangs (120, FIG. 16) having cylindrical bores (121, FIGS. 18–19) through which the rotary pivot members (106, FIG. 16) pass, wherein, in accordance with the improvement:

the elongate scaffold elements (77, 117) are made not of steel but of light-metal profiled stock, the vertical dimension (e.g., 58.3, FIG. 3) between the top and bottom boundaries of each coupling head (25 or 105), proceeding in the direction radially away from the associated scaffold post (20), gradually diminishes to about the diameter or vertical dimension of the elongate scaffold element (77 or 117) connected to the respective coupling head the coupling head (25 or 105), and the top and bottom boundaries (56.2, 56.1, FIG. 8) of the coupling heads (25; 105) at said radially inward bearing surfaces (50.2, 50.1, FIG. 8) thereof are vertically spaced by unequal distances (58.2, 58.1, FIG. 8) from the horizontal median planes (57) of the respective horizontally oriented apertured disks (22) and are vertically spaced by approximately equal distances (61, 61, FIG. 3) from the locations (60, FIG. 3) at which the respective wedge-like keys (26) are wedged against the radially outer margin of a respective disk aperture (24), the coupling heads (25; 105) each include, immediately above and immediately below the top and bottom major faces of the associated apertured disk (22), a respective top pair of laterally projecting wings (65, FIG. 9) which at least in part constitute the top boundary surface of said disk-receiving slot (49) and a respective bottom pair of laterally projecting wings (65, FIG. 9) which at least in part constitute the bottom boundary surface of said disk-receiving slot (49), the two wings (65, FIG. 9) of each pair of wings projecting in opposite respective directions laterally outward from the coupling head (25; 105) and at least in part defining said convergent lateral boundaries (46, 46, FIG. 7) of said coupling head (25; 105), the top wings (65, FIG. 9) engaging (FIG. 2) the top major face of the associated disk (22) at disk locations (FIG. 2) where no other portion of the respective coupling head (25; 105) does so, and the bottom wings (65) engaging the bottom major face of the associated disk (22) at disk locations where no other portion of the respective coupling head (25; 105) does so, whereby to increase at such disk locations, in the immediate vicinity of said disk-receiving slot (49), and thus in the immediate vicinity of engagement between the coupling head (25; 105) and the apertured disk (22), the transverse breadth of engagement between the former (25; 105) and the latter (22) and 131 thereby increase resistance to forces tending to tilt or twist the coupling head (25; 105) about a radius of the apertured disk (22), the extensions with which coupling heads for horizontal elongate light-metal scaffold elements are provided being hollow extensions with an interior peripheral wall defining an interior space (79) of generally truncated-cone shape such that the wall thickness of each extension (75) increases proceeding in the direction (leftwards, FIG. 8) from the end of the extension (75) distant from the associated coupling head (25; 105) toward the end of the extension (75) near to the associated coupling head (25; 105), the extensions (75) having respective longitudinal axes (57), the interior peripheral wall of each such extension (75, FIG. 8), at the region (80) close to the associated coupling head (25; 105), curving inwardly (82) towards the longitudinal axis (57) of the extension (75) to form, at the region (81) of juncture where the extension (75) and associated coupling head (25; 105) meet, a wall thickness of more rapidly increasing value, whereby to compensate, interiorly, for the aforementioned gradual diminishment of the vertical dimension (58.3, FIG. 8) between the top (56.2) and bottom (56.1) boundaries of the coupling head (25; 105) and whereby, furthermore, to provide at said region (81) of juncture where the extension (75) and associated coupling head (25; 105) meet, a region (81) of substantially increased wall thickness able to withstand loads applied to said region (81) of juncture, the diagonal elongate scaffold elements (117) are provided at their ends with tang-link heads (110, FIG. 17) having flat tangs (120, FIG. 16) fabricated by deformation of sheet-steel elements or else are cast or forged steel members, these tang-link heads (110, FIG. 17), at their ends remote from their tangs (120, FIG. 16), being provided with extensions (111, FIGS. 16–17) which enter into and engage the interiors of such diagonal elongate scaffold elements (117, FIG. 17) and are held therein by means of inwardly deformed portions (FIG. 17 - cf. 84 in FIG. 2) of such diagonal scaffold elements (117), these inwardly deformed portions engaging apertures (113, FIG. 18) or recesses (113) at the exteriors of such extensions (111).

2. A scaffold system as defined in claim 1, wherein, in further accordance with the improvement:

the apertured disks (22) have an outer diameter of 124 mm and an axial thickness of 10 mm.

3. A scaffold system as defined in claim 1, wherein, in further accordance with the improvement:

the elongate scaffold elements (77) are of closed annular cross section to facilitate introduction thereinto of said extensions (75) of said coupling heads (25) and are each provided with at least one downwardly projecting reinforcing web (91, FIGS. 3, 14) at whose lower end there is provided a generally horizontal reinforcing flange (92, FIGS. 3, 14).

4. A scaffold system as defined in claim 1 or 3, the scaffold system furthermore including planking units (28, FIG. 1) combinable to form scaffold platforms, the planking (28) units being provided at their ends with suspension claws (28.1, FIG. 1) designed to rest atop horizontally extending elongate scaffold elements (77), wherein, in further accordance with the improvement:

the scaffold elements (77) are provided with longitudinally extending, upwardly oriented, legs (93.1, 93.2) transversely spaced from each other a distance corresponding to the dimensions of such suspension claws (28.1).

5. A scaffold system as defined in claim 3, wherein said closed annular cross section is a circular cross section.

6. An improved scaffold system of the type which comprises:

vertical posts, horizontally oriented annular apertured disks secured to the vertical posts and spaced along the lengths of the posts at intervals corresponding to a grid pattern to be formed for the scaffold system, the apertured disks having a circumferential succession of key-receiving apertures, the apertured disks and the respective posts to which they are secured sharing common center axes, the first apertured disks being made of steel with an outer diameter of 122 mm and an axial thickness of 9 mm, first coupling heads, wedge-like keys for securing coupling heads to respective apertured disks, wherein the first coupling heads have horizontal disk-receiving slots located intermediate the top and bottom boundaries of the coupling heads, so that a coupling head can be pushed onto, and thereby be mounted on, an apertured disk in such a manner that the apertured disk enters the disk-receiving slot of the coupling head with the top and bottom faces of the disk thereby engaged by the coupling head, wherein the coupling heads furthermore have radially inward bearing surfaces that radially bear against a respective post in surface-to-surface contact therewith when the coupling head is pushed onto an associated apertured disk, the radially inward bearing surfaces of a coupling head including a top bearing surface located above and a bottom bearing surface located below the horizontal disk-receiving slot of the coupling head, wherein the coupling heads have convergent lateral boundaries each of which extends in the direction toward the common center axes of the associated posts and apertured disks, wherein the coupling heads have key-receiving spaces formed by paired key-receiving openings, the top opening being located above and the bottom opening below the disk-receiving slot of the respective coupling head, wherein the keys each extend down through the top key-receiving opening of a respective coupling head, then down through one of the apertures of an associated apertured disk when the coupling head is in mounted position on such disk, and then finally down through the bottom key-receiving opening of the respective coupling head, wherein the keys are each wedged between the radially outer margin of a disk aperture and a radially inward surface of the key-receiving space of a respective coupling head, wherein the scaffold system furthermore includes first elongate scaffold elements made of steel, and wherein means are provided for connecting the radially outward ends of the coupling heads to the elongate scaffold elements in such a manner that the elongate scaffold elements extend horizontally, the improvement comprising:

the additional provision of second coupling heads (25 or 105) made of steel but differing in configuration from the first coupling heads, second apertured disks (22) made not of steel but of light metal, and second elongate scaffold elements (77 or 117) made not of steel but of light metal, whereby to achieve a weight decrease which facilitates transport and portability of the scaffold in erected but especially in dismantled condition, wherein the second coupling heads (25 or 105), in order to be able to cooperate with first apertured disks made of steel, have disk-receiving slots (49) of the same vertical dimensions as do the first coupling heads, wherein: in order to compensate for any structural strength inferiority of their constituent light metal compared to steel, the light-metal second apertured disks (22) exploit the possibility of reduced vertical play of the apertured disks (22) in the disk-receiving slots (49) by having an axial thickness not of 9 mm but instead 10 mm wherein: for compatibility with first coupling heads and with said wedge-like keys of said steel first apertured disks, the second apertured disks (22) are receivable in the disk-receiving slots (49) of both the first coupling heads and the second coupling heads (25 or 105) and furthermore have disk apertures (24.1, 24.2) of the same shapes and dimensions as those of the steel first apertured disks, wherein: in order to further compensate for any structural strength inferiority of their constituent light metal compared to steel, the light-metal second apertured disks (22) have an outer diameter not of 122 mm but instead 124 mm, wherein: the steel second coupling heads (25 or 105), in order to effect a weight decrease thereof despite the fact that these are made of steel and not of light metal, have vertical dimensions (e.g. 58.3, FIG. 3) between the top and bottom boundaries thereof which, proceeding in the direction radially away from the associated scaffold post (20), gradually diminish to about the diameter or vertical dimension of the employed elongate scaffold element (77 or 117), wherein: the top and bottom boundaries (56.2, 56.1, FIG. 8) of the second coupling heads (25 or 105) at said radially inward bearing surfaces (50.2, 50.1, FIG. 8) thereof are vertically spaced by unequal distances (58.2, 58.1, FIG. 8) from the horizontal median plane (57) of a respective horizontally oriented second apertured disk (22) and are vertically spaced by approximately equal distances (61, 61, FIG. 3) from the locations (60, FIG. 3) at which the respective wedge-like keys (26) are wedged against the radially outer margin of a disk aperture (24), wherein: the steel second coupling heads (25 or 105) each include, immediately above and immediately below the top and bottom major faces of the associated apertured disk (22), a respective top pair of laterally projecting wings (65, FIG. 9) which at least in part constitute the top boundary surface of said disk-receiving slot (49) and a respective bottom pair of laterally projecting wings (65, FIG. 9) which at least in part constitute the bottom boundary surface of said disk-receiving slot (49), the two wings (65, FIG. 9) of each pair of wings projecting in opposite respective directions laterally outward from the respective second coupling head (25 or 105) and at least in part defining said convergent lateral boundaries (46, 46, FIG. 7) of said second coupling head (25 or 105), the top wings (65) engaging (FIG. 2) the top major face of the associated disk (22) at disk locations (FIG. 2) where no other portion of the respective coupling head (25 or 105) does so, and the bottom wings (65) engaging the bottom major face of the associated disk (22) at wing-disk engagement locations where no other portion of the respective coupling head (25 or 105) does so, whereby, for cases in which a second coupling head (25 or 105) is in engagement with an apertured disk (22), said top and bottom pairs of laterally projecting wings (65) produce at said wing-disk engagement locations (e.g., FIG. 2), and thus in the immediate vicinity of engagement between a second coupling head (25 or 105) and a second apertured disk (22), an increase of the transverse breadth of engagement between the former (25 or 105) and the latter (22), and thereby increase resistance to forces tending to tilt or twist the second coupling head (25 or 105) about a radius of the associated apertured disk (22).

7. An improved scaffold system of the type which comprises:

vertical posts (20), horizontally oriented annular apertured disks (22) secured to the vertical posts (20) and spaced along the lengths of the posts (20) at intervals corresponding to a grid pattern to be formed for the scaffold system, the apertured disks (22) having a circumferential succession of key-receiving apertures (24.1, 24.2, FIG. 10), the apertured disks (22) and the respective posts (20) to which they are secured sharing common center axes (37, FIG. 10), coupling heads (25, FIGS. 2–9, 12–13; / 105, FIGS. 16–17, 20) and wedge-like keys (26) for securing the coupling heads (25; 105) to respective apertured disks (22), wherein the coupling heads (25; 105) have horizontal disk-receiving slots (49, FIGS. 8–9) located intermediate the top (56.2, 64.2) and bottom (56.1, 64.1) boundaries of the coupling heads (25; 105), so that a coupling head (25; 105) can be pushed onto, and thereby be mounted on, apertured disk (22) in such a manner that the apertured disk (22) enters the disk-receiving slot (49) of the coupling head (25; 105) with the top and bottom faces of the disk (22) thereby engaged by the coupling head (25; 105), wherein the coupling heads (25; 105) furthermore have radially inward bearing surface (50, FIG. 7) that radially bear (FIG. 2) against a respective post (20) in surface-to-surface contact therewith when the coupling head (25; 105) is pushed onto an associated apertured disk (22), the radially inward bearing surfaces (50) of a coupling head (25; 105) including (FIG. 8) a top bearing surface (50.2) located above and a bottom bearing surface (50.1) located below the horizontal disk-receiving slot (49) of the coupling head (25; 105), wherein the coupling heads (25; 105) have (e.g. FIG. 7) convergent lateral boundaries (46, 46) each of which extends in the direction toward the common center axes (37, FIG. 10) of the associated posts (20) and apertured disks (22), wherein the coupling heads (25; 105) have key-receiving spaces formed by paired key-receiving openings (53.1, 53.2, FIG. 8), the top opening (53.1) being located above and the bottom opening (53.2) below the disk-receiving slot (49) of the respective coupling head (25; 105), wherein the keys (26, FIG. 2) each extend down through the top key-receiving opening (53.1, FIG. 3) of a respective coupling head (25; 105), then down through one of the apertures (24) of an associated apertured disk (22) when the coupling head (25; 105) is in mounted position on such disk (22), and then finally down through the bottom key-receiving opening (53.2) of the respective coupling head (25; 105), wherein the keys (26) are each wedged (60, FIG. 3) between the radially outer margin (36, FIG. 11) of a disk aperture (24.1) and a radially inward surface of the key-receiving space (53.1, 53.2, FIG. 8) of a respective coupling head (25; 105), wherein the scaffold system furthermore includes elongate scaffold elements (77, FIG. 2; 117, FIG. 16), wherein means (75, FIGS. 6–7 and 83, 84, FIG. 2; 106, 110, FIG. 17) are provided for connecting the radially outward ends of the coupling heads (25; 105) to the elongate scaffold elements (77; 117) in such a manner that the elongated scaffold elements (77; 117) extend horizontally, and wherein the coupling heads (25: 105) are made of steel, wherein, in accordance with the improvement:

the elongated scaffold elements (77; 117) are made not of steel but of light metal, whereby to achieve a weight decrease which facilitates transport and portability of the scaffold in erected by especially in dismantled condition, and wherein, in further accordance with the improvement:

the top and bottom boundaries (56.2, 56.1, FIG. 8) of the coupling heads (25; 105) at said radially inward bearing surfaces (50.2, 50.1, FIG. 8) thereof are vertically spaced by unequal distances (58.2, 58.1, FIG. 8) from the horizontal median planes (57) of the respective horizontally oriented apertured disks (22) and are vertically spaced by approximately equal distances (61, 61, FIG. 3) from the locations (60, FIG. 3) at which the respective wedge-like keys (26) are wedged against the radially outer margin of a respective disk aperture (24).

8. An improved scaffold system of the type which comprises:

vertical posts (20), horizontally oriented annular aperture disks (22) secured to the vertical posts (20) and spaced along the lengths of the posts (20) at intervals corresponding to a grid pattern to be formed for the scaffold system, the aperture disks (22) having a circumferential succession of key-receiving apertures (24.1, 24.12, FIG. 10), the apertured disks (22) and the respective posts (20) to which they are secured sharing common center axes (37, FIG. 10), coupling heads (25, FIGS. 2–9, 12–13; / 105, FIGS. 16–17, 20) and wedge-like keys (26) for securing the coupling heads (25; 105) to respective apertured disks (22), wherein the coupling heads (25; 105) have horizontal disk-receiving slots (49, FIGS. 8–9) located intermediate the top (56.2, 64.2) and bottom (56.1, 64.1) boundaries of the coupling heads (25; 105), so that a coupling head (25; 105) can be pushed onto, and thereby be mounted on, an apertured disk (22) in such a manner that the apertured disk (22) enters the disk-receiving slot (49) of the coupling head (25; 105) with the top and bottom faces of the disk (22) thereby engaged by the coupling head (25; 105), wherein the coupling heads (25; 105) furthermore have radially inward bearing surface (50, FIG. 7) that radially bear (FIG. 2) against a respective post (20) in surface-to-surface contact therewith when the coupling head (25; 105) is pushed onto an associated apertured disk (22), the radially inward bearing surfaces (50) of a coupling head (25; 105) including (FIG. 8) a top bearing surface (50.2) located above and a bottom bearing surface (50.) located below the horizontal disk-receiving slot (49) of the coupling head (25; 105), wherein the coupling heads (25; 105) have (e.g. FIG. 7) convergent lateral boundaries (46, 46) each of which extends in the direction toward the common center axes (37, FIG. 10) of the associated posts (20) and apertured disks (22), wherein the coupling heads (25; 105) have key-receiving spaces formed by paired key-receiving opening (53.1, 53.2, FIG. 8), the top opening (53.1) being located above and the bottom opening (53.2) below the disk-receiving slot (49) of the respective coupling head (25; 105), wherein the keys (26, FIG. 2) each extend down through the top key-receiving opening (53.1, FIG. 3) of a respective coupling head (25; 105), then down through one of the apertures (24) of an associated apertured disk (22) when the coupling head (25; 105) is in mounted position on such disk (22), and then finally down through the bottom key-receiving opening (53.2) of the respective coupling head (25; 105), wherein the keys (26) are each wedged (60, FIG. 3) between the radially outer margin (36, FIG. 11) of a disk aperture (24.1) and a radially inward surface of the key-receiving space (53.1, 53.2, FIG. 8) of a respective coupling head (25; 105), wherein the scaffold system furthermore includes elongate scaffold elements (77, FIG. 2; 117, FIG. 16), wherein means (75, FIGS. 6–7 and 83, 84, FIG. 2; 106, 110, FIG. 17) are provided for connecting the radially outward ends of the coupling heads (25; 105) to the elongate scaffold elements (77; 117) in such a manner that the elongate scaffold elements (77; 117) extend horizontally, and wherein the coupling heads (25; 105) are made of steel, wherein, in accordance with the improvements:

the elongate scaffold elements (77; 117) are made not of steel but of light metal, whereby to achieve a weight decrease which facilitates transport and portability of the scaffold in erected but especially in dismantled condition, wherein, in further accordance with the improvement:

the horizontally oriented apertured disks (22) are made not of steel but of light metal, whereby to achieve a further such weight decrease, and wherein, in further accordance with the improvement:

the top and bottom boundaries (56.2, 56.1, FIG. 8) of the coupling heads (25; 105) at said radially inward bearing surfaces (50.2, 50.1, FIG. 8) thereof are vertically spaced by unequal distances (58. 2, 58.1, FIG. 8) from the horizontal median planes (57) of the respective horizontally oriented apertured disks (22) and are vertically spaced by approximately equal distances (61, 61, FIG. 3) from the locations (60, FIG. 3) at which the respective wedge-like keys (26) are wedged against the radially outer margin of a respective disk aperture (24).

9. An improved scaffold system of the type which comprises:

vertical posts (20), horizontally oriented annular apertured disks (22) secured to the vertical posts (20) and spaced along the lengths of the posts (20) at intervals corresponding to a grid pattern to be formed for the scaffold system, the apertured disks (22) having a circumferential succession of key-receiving apertures (24.1, 24.2, FIG. 10), the apertured disks (22) and the respective posts (20) to which they are secured sharing common center axes (37, FIG. 10), coupling heads (25, FIGS. 2–9, 12–13; / 105, FIGS. 16–17, 20) and wedge-like keys (26) for securing the coupling heads (25; 105) to respective apertured disks (22), wherein the coupling heads (25; 105) have horizontal disk-receiving slots (49, FIGS. 8–9) located intermediate the top (56.2, 64.2) and bottom (56.1, 64.1) boundaries of the coupling heads (25; 105), so that a coupling head (25; 105) can be pushed onto, and thereby be mounted on, an apertured disk (22) in such a manner that the apertured disk (22) enters the disk-receiving slot (49) of the coupling head (25; 105) with the top and bottom faces of the disk (22) thereby engaged by the coupling head (25; 105), wherein the coupling heads (25; 105) furthermore have radially inward bearing surfaces (50, FIG. 7) that radially bear (FIG. 2) against a respective post (20) in surface-to-surface contact therewith when the coupling head (25; 105) in pushed onto an associated apertured disk (22), the radially inward bearing surfaces (50) of a coupling head (25; 105) including (FIG. 8) a top bearing surface (50.2) located above and a bottom bearing surface (50.1) located below the horizontal disk-receiving slot (49) of the coupling head (25; 105), wherein the coupling heads (25; 105) have (e.g. FIG. 7) convergent lateral boundaries (46, 46) each of which extends in the direction toward the common center axes (37, FIG. 10) of the associated posts (20) and apertured disks (22), wherein the coupling heads (25; 105) have key-receiving spaces formed by paired key-receiving openings (53.1, 53.2, FIG. 8), the top opening (53.1) being located above and the bottom openings (53.2) below the disk-receiving slot (49) of the respective coupling head (25; 105), wherein the keys (26, FIG. 2) each extend down through the top key-receiving opening (53.1, FIG. 3) of a respective coupling head (25; 105), then down through one of the apertures (24) of an associated apertured disk (22) when the coupling head (25; 105) is in mounted position on such disk (22), and then finally down through the bottom key-receiving opening (53.2) of the respective coupling head (25; 105), wherein the keys (26) are each wedged (60, FIG. 3) between the radially outer margin (36, FIG. 11) of a disk aperture (24.1) and a radially inward surface of the key-receiving space (53.1, 53.2, FIG. 8) of a respective coupling head (25; 105), wherein the scaffold system furthermore includes elongate scaffold elements (77, FIG. 2; 117, FIG. 16), wherein means (75, FIGS. 6–7 and 83, 84, FIG. 2; 106, 110, FIG. 17) are provided for connecting the radially outward ends of the coupling heads (25; 105) to the elongate scaffold elements (77; 117) in such a manner that the elongate scaffold elements (77; 117) extend horizontally, and wherein the coupling heads (25; 105) are made of steel, wherein, in accordance with the improvement:

the elongate scaffold elements (77; 117) are made not of steel but of light metal, whereby to achieve a weight decrease which facilitates transport and portability of the scaffold in erected but especially in dismantled condition, wherein the elongate scaffold elements (77) are of at least generally annular cross-section and accordingly have interiors, and wherein the coupling heads (25) furthermore are provided at their radially outward ends with extensions (75) of such a cross section that the extensions (75) can fit into the interiors of the elongate scaffold elements (77) in order to engage such interiors, and wherein, in further accordance with the improvement:

the vertical dimension (58.3, FIG. 3) between the top and bottom boundaries of each coupling head (25), proceeding in the direction radially away from the associated scaffold post (20), gradually diminishes to about the diameter or vertical dimension of the elongate scaffold element (77) that is engaged by the extension (75) of the coupling head (25), and wherein the top and bottom boundaries (56.2, 56.1, FIG. 8) of the coupling heads (25) at said radially inward bearing surfaces (50.2, 50.1, FIG. 8) thereof are vertically spaced by unequal distances (58.2, 58.1, FIG. 8) from the horizontal median planes (57) of the respective horizontally oriented apertured disks (22) and are vertically spaced by approximately equal distances (61, 61, FIG. 3) from the locations (60, FIG. 3) at which the respective wedge-like keys (26) are wedged against the radially outer margin of a respective disk aperture (24).

10. A scaffold system as defined in claim 9 or claim 2, wherein, in further accordance with the improvement:

the extensions (75, FIG. 8) are hollow (79, FIG. 8) with an interior peripheral wall defining an interior space (79) of generally truncated-cone shape such that the wall thickness of each extension (75) increases proceeding in the direction (leftwards, FIG. 8) from the end of the extension (75) distant from the associated coupling head (25) toward the end of the extension (75) near to the associated coupling head (25), the extensions (75) having respective longitudinal axes (57), the interior peripheral wall of each such extension (75, FIG. 8), at the region (80) close to the associated coupling head (25), curving inwardly (82) towards the longitudinal axis (57) of the extension (75) to form, at the region (81) of juncture where the extension (75) and associated coupling head (25) meet, a more rapidly increasing wall thickness, whereby to compensate, interiorly, for the aforementioned gradual diminishment of the vertical dimension (58.3, FIG. 8) between the top (56.2) and bottom (56.1) boundaries of the coupling head(25) and whereby, furthermore, to provide at said region (81) of juncture where the extension (75) and associated coupling head (25) meet, a region (81) of substantially increased wall thickness able to withstand loads applied to said region (81) of juncture.

11. A scaffold system as defined in claim 9 or claim 2, wherein the top key-receiving opening (53.1, FIGS.. 8–9) have walls shaped to include lateral holding ribs (66, FIGS. 8–9) for the respective wedge-like keys (26).

Figure 17:
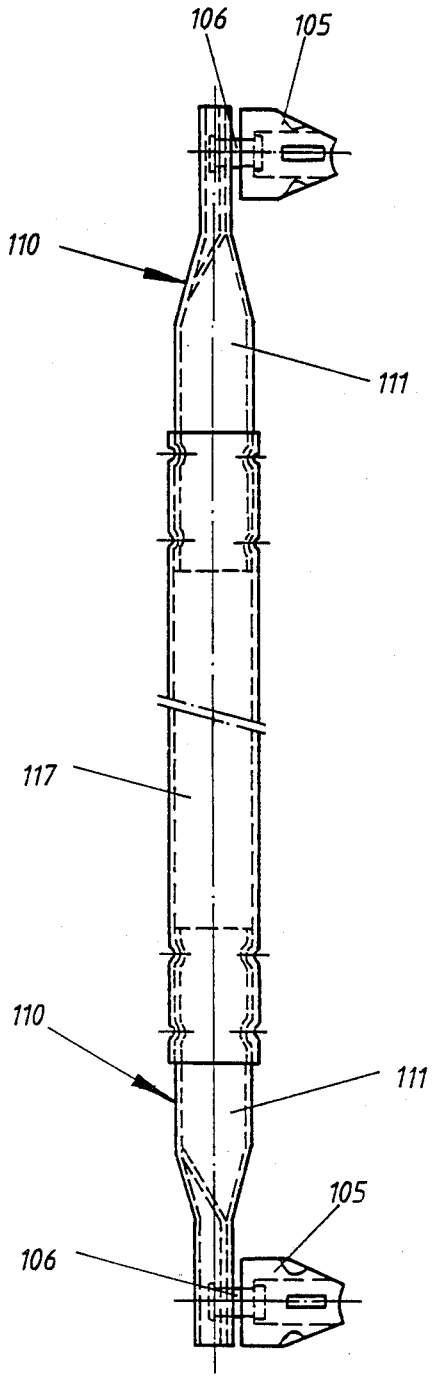
FIG. 17 is a side view of a diagonal scaffold element and of the tang-link heads and the coupling heads at the two ends of the scaffold element.
Figure 18:
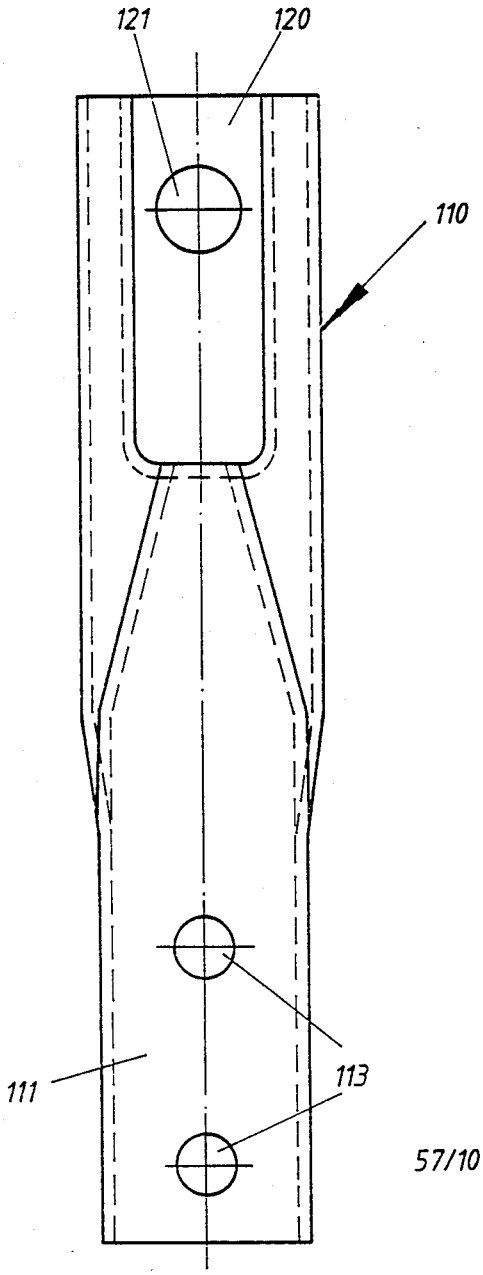
FIG. 18 is a side view of a tang-link head for a diagonally extending pipe-like scaffold element, shown on an enlarged scale.
Figure 19:
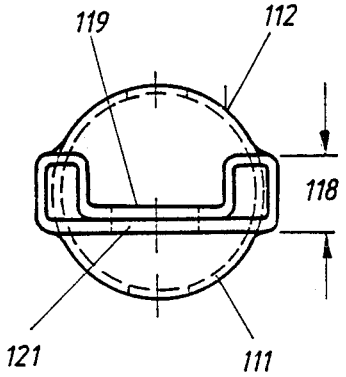
FIG. 19 is an end view of the tang-link head of FIG. 18.

12. An improved scaffold system of the type which comprises:

vertical posts (20), horizontally oriented annular apertured disks (22) secured to the vertical posts (20) and spaced along the lengths of the posts (20) at intervals corresponding to a grid pattern to be formed for the scaffold system, the apertured disks (22) having a circumferential succession of key-receiving apertures (24.1, 24.2, FIG. 10), the apertured disks (22) and the respective posts (20) to which they are secured sharing common center axes (37, FIG. 10), coupling heads 925, FIGS. 2–9, 12–13; / 105, FIGS. 16–17, 20) and wedge-like keys (26) for securing the coupling heads (25; 105) to respective apertured disks (22), wherein the coupling heads (25; 105) have horizontal disk-receiving slots (46, FIGS. 8–9) located intermediate the top (56.2, 64.2) and bottom (56.1, 64.1) boundaries of the coupling heads (25; 105), so that a coupling head (25; 105) can be pushed onto, and thereby be mounted on, an apertured disk (22) in such a manner that the apertured disk (22) enters the disk-receiving slot (49) of the coupling head (25; !05) with the top and bottom faces of the disk (22) thereby engaged by the coupling head (25; 105), wherein the coupling heads (25; 105) furthermore have radially inward bearing surfaces (50, FIG. 7) that radially bear (FIG. 2) against a respective post (20) in surface-to-surface contact therewith when the coupling head (25 105) is pushed onto an associated apertured disk (22), the radially inward bearing surfaces (50) of a coupling head (25; 105) including (FIG. 8) a top bearing surface (50.2) located above and a bottom bearing surface (50.1) located below the horizontal disk-receiving slot (49) of the coupling head (25; 105), wherein the coupling heads (25; 105) have (e.g. FIG. 7) convergent lateral boundaries (46, 46) each of which extends in the direction toward the common center axes (37, FIG. 10) of the associated posts (20) and apertured disks (22), wherein the coupling heads (25; 105) have key-receiving spaces formed by paired key-receiving openings (53.1, 53 2, FIG. 8), the top opening (53.1) being located above and the bottom opening (53.2) below the disk-receiving slot (49) of the respective coupling head (25; 105), wherein the keys (26, FIG. 2) each extend down through the top key-receiving opening (53.1, FIG. 3) of a respective coupling head (25; 105), then down through one of the apertures (24) of an associated aperture disk (22) when the coupling head (25; 105) is in mounted position on such disk (22), and then finally down through the bottom key-receiving opening (53.2) of the respective coupling head (25; 105), wherein the keys (26) are each wedged (60, FIG. 3) between the radially outer margin (36, FIG. 11) of a disk aperture (24.1) and a radially inward surface of the key-receiving space (53.1, 53.2, FIG. 8) of a respective coupling head (25; 105), wherein the scaffold system further more includes elongate scaffold elements (77, FIG. 2; 117, FIG. 16), wherein means (75, FIGS. 6–7 and 83, 84, FIG. 2; 106, 110, FIG. 17) are provided for connecting the radially outward ends of the coupling heads (25; 105) to the elongate scaffold elements (77; 117) in such a manner that the elongated scaffold elements (77; 117) extend horizontally, and wherein the coupling heads (25; 105) are made of steel, wherein, in accordance with the improvement:

the elongate scaffold elements (77; 117) are made not of steel but of light metal, whereby to achieve a weight decrease which facilitates transport and portability of the scaffold in erected but especially in dismantled condition, and wherein, in further accordance with the improvement:

the horizontally oriented apertured disks (22) are made not of steel but of light metal, whereby to achieve a further such weight decrease, wherein the elongate scaffold elements (77) are of at least generally annular cross-section and accordingly have interiors, and wherein the coupling heads (25) furthermore are provided at their radially outward ends with extensions (75) of such a cross section that the extensions (75) can fit into the interiors of the elongate scaffold elements (77) in order to engage such interiors, and wherein, in further accordance with the improvement:

the vertical dimension (58.3, FIG. 3) between the top and bottom boundaries of each coupling head (25), proceeding in the direction radially away from the associated scaffold post (20), gradually diminishes to about the diameter or vertical dimension of the elongate scaffold element (77) that is engaged by the extension (75) of the coupling head (25), and wherein the top and bottom boundaries (56.2, 56.1, FIG. 8) of the coupling heads (25) at said radially inward bearing surfaces (50.2, 50.1, FIG. 8) thereof are vertically spaced by unequal distances (58.2, 58.1, FIG. 8) from the horizontal median planes (57) of the respective horizontally oriented apertured disks (22) and are vertically spaced by approximately equal distance (61, 61, FIG. 3) from the locations (60, FIG. 3) at which the respective wedge-like keys (26) are wedged against the radially outer margin of a respective disk aperture (24).

13. An improved scaffold system of the type which comprises:

vertical posts (20), horizontally oriented annular apertured disks (22) secured to the vertical posts (20) and spaced along the lengths of the posts (20) at intervals corresponding to a grid pattern to be formed for the scaffold system, the apertured disks (22) having a circumferential succession of key-receiving apertures (24.1, 24.2, FIG. 10) the apertured disks (22) and the respective posts (20) to which they are secured sharing common center axes 937, FIG. 10), coupling heads (25, FIGS. 2–9, 12–13; / 105, FIGS. 16–17, 20) and wedge-like keys (26) for securing the coupling heads (25; 105) to respective apertured disks (22), wherein the coupling heads (25; 105) have horizontal disk-receiving slots (49, FIGS. 8–9) located intermediate the top (56.2, 64.2) and bottom (56.1, 64.1) boundaries of the coupling heads (25; 105), so that a coupling head (25; 105) can be pushed onto, and thereby by mounted on, an apertured disk (22) in such a manner that the apertured disk (22) enters the disk-receiving slot (49) of the coupling head (25; 105) with the top and bottom faces of the disk (22) thereby engaged by the coupling head (25; 105), wherein the coupling heads (25; 105) furthermore have radially inward bearing surfaces (50, FIG. 7) that radially bear (FIG. 2) against a respective post (20) in surface-to-surface contact therewith when the coupling head (25; 105) is pushed onto an associated apertured is (22), the radially inward bearing surfaces (50) of a coupling head (25; 105) including (FIG. 8) a top bearing surface (50.2) located above and a bottom bearing surface (50.1) located below the horizontal disk-receiving slot (49) of the coupling head (25; 105), wherein the coupling heads (25; 105) have (e.g. FIG. 7) convergent lateral boundaries (46, 46) each of which extends in the direction toward the common center axes (37, FIG. 10) of the associated posts (20) and apertured disks (22), wherein the coupling heads (25; 105) have key-receiving spaced formed by paired key-receiving openings (53.1, 53.2, FIG. 8), the top opening (53.1) being located above and the bottom opening (53.2) below the disk-receiving slot (49) of the respective coupling head (25; 105), wherein the keys (26, FIG. 2) each extend down through the top key-receiving opening (53.1, FIG. 3) of a respective coupling head (25; 105), then down through one of the apertures (24) of an associated apertured disk (22) when the coupling head (25; 105) is in mounted position on such disk (22), and then finally down through the bottom key-receiving opening (53.2) of the respective coupling head (25; 105), wherein the keys (26) are each wedged (60, FIG. 3) between the radially outer margin (36, FIG. 11) of a disk aperture (24.1) and a radially inward surface of the key-receiving space (53.1, 53.2, FIG. 8) of a respective coupling head (25; 105), wherein the scaffold system furthermore includes elongate scaffold elements (77, FIG. 2; 117, FIG. 16), wherein means (75, FIGS. 6–7 and 83, 84, FIG. 2; 106, 110, FIG. 17) are provided for connecting the radially outward ends of the coupling heads (25; 105) to the elongate scaffold elements (77; 117) in such a manner that the elongated scaffold elements (77; 117) extend horizontally, and wherein the coupling heads (25; 105) are made of steel, wherein, in accordance with the improvement:

the elongate scaffold elements (77; 117) are made not of steel but of light metal, whereby to achieve a weight decrease which facilitates transport and potability of the scaffold in erected but especially in dismantled condition, wherein, in further accordance with the improvement:

the horizontally oriented apertured disks (22) are made not of steel but of light metal, whereby to achieve a further such weight decrease, and wherein, in further accordance with the improvement:

the coupling heads (25; 105) each include, immediately above and immediately below the top and bottom major faces of the associated apertured disk (22), a respective top pair of laterally projecting wings (65.1, FIG. 9) which at least in part constitute the top boundary surface of said disk-receiving slot (49) and a respective bottom pair of laterally projecting wings (65.2, FIG. 9) which at least in part constitute the bottom boundary surface of said disk-receiving slot (49), the two wings (65, FIG. 9) of each pair of wings projecting in opposite respective directions laterally outward from the coupling head (25; 105) and at least in part defining said convergent lateral boundaries (46, 46, FIG. 7) of said coupling head (25; 105), the top wings (65.11, FIG. 9) engaging (FIG. 2) the top major face of the associated disk (22) at disk locations (FIG. 2) where no other portion of the respective coupling head (25; 105) does so, and the bottom wings (65.2) engaging the bottom major face of the associated disk (22) at disk locations where not other portion of the respective coupling head (25; 105) does so, whereby to increases at such disk locations, in the immediate vicinity of said disk-receiving slot (49), and thus in the immediate vicinity of engagement between the coupling head (25; 105) and the apertured disk (22), the transverse breadth of engagement between the former (25; 105) and the latter (22) and thereby increase resistance to forces tending to tilt or twist the coupling head (25; 105) about a radius of the apertures disk (22).

14. An improved scaffold system of the type which comprises:

vertical posts (20), horizontally oriented annular apertured disks (22) secured to the vertical posts (20) and spaced along the lengths of the posts (20) at intervals corresponding to a grid pattern to be formed for the scaffold system, the apertured disks (22) having a circumferential succession of key-receiving apertures (24.1, 24.2, FIG. 10), the apertured disks (22) and the respective posts (20) to which they are secured sharing common center axes (37, FIG. 10), coupling heads (25, FIGS. 2–9, 12–13; / 105, FIGS. 16–17, 20) and wedge-like keys (26) for securing the coupling heads (25; 105) to respective apertured disks (22), wherein the coupling heads (25; 105) have horizontal disk-receiving slots (49, FIGS. 8–9) located intermediate the top (56.2, 64.2) and bottom (56.1, 64.1) boundaries of the coupling heads (25; 105), so that a coupling head (25; 105) can be pushed onto, and thereby be mounted on, an apertured disk (22) in such a manner that the aperture disk (22) enters the disk-receiving slot (49) of the coupling head (25; 105) with the top and bottom faces of the disk (22) thereby engaged by the coupling head (25; 105), wherein the coupling heads (25; 105) furthermore have radially inward bearing surfaces (50, FIG. 7) that radially bear (FIG. 2) against a respective post (20) in surface-to-surface contact therewith when the coupling head (25; 105) is pushed onto an associated apertured disk (22), the radially inward bearing surfaces (5) of a coupling head (25; 105) including (FIG. 8) a top bearing surface (50.2) located above and a bottom bearing surface (50.1) located below the horizontal disk-receiving slot (49) of the coupling head (25; 105), wherein the coupling heads (25; 105) have (e.g. FIG. 7) convergent lateral boundaries (46, 46) each of which extends in the direction toward the common center axes (37, FIG. 10) of the associated posts (20) and apertured disks (22), wherein the coupling heads (25; 105) have key-receiving spaces formed by paired key-receiving openings (53.1, 53.2, FIG. 8), the top opening (53.1) being located above and the bottom opening (53.2) below the disk-receiving slot (49) of the respective coupling head (25; 105), wherein the keys (26, FIG. 2) each extend down through the top key-receiving opening (53.1, FIG. 3) of a respective coupling head (25; 105), then down through one of the apertures (24) of an associated aperture disk (22) when the coupling head (25; 105) is in mounted position on such disk (22), and then finally down through the bottom key-receiving opening (53.2) of the respective coupling head (25; 105), wherein the keys (26) are each wedged (60, FIG. 3) between the radially outer margin (36, FIG. 11) of a disk aperture (24.1) and a radially inward surface of the key-receiving space (53.1, 53.2, FIG. 8) of a respective coupling head (25; 105), wherein the scaffold system furthermore includes elongate scaffold elements (77, FIG. 2; 117, FIG. 16), wherein means (75, FIGS. 6–7 and 83, 84, FIG. 2; 106, 110, FIG. 17) are provided for connecting the radially outward ends of the coupling heads (25; 105) to the elongate scaffold elements (77; 117) in such a manner that the elongate scaffold elements 77; 117) extend horizontally, and wherein the coupling heads (25; 105) are made of steel, wherein, in accordance with the improvement:

the elongate scaffold elements (77; 117) are made not of steel but of light metal, whereby to achieve a weight decrease which facilitates transport and portability of the scaffold in erected but especially in dismantled condition, and wherein, in further accordance with the improvement:

the coupling heads (25; 105) each include, immediately above and immediately below the top and bottom major faces of the associated apertured disk (22), a respective top pair of laterally projecting wings (65.1, FIG. 9) which at least in part constitute the top boundary surface of said disk-receiving slot (49) and a respective bottom pair of laterally projecting wings (65.2, FIG. 9) which at least in part constitute the bottom boundary surface of said disk-receiving slot (49), the two wings (65, FIG. 9) of each pair of wings projecting in opposite respective directions laterally outward from the coupling head (25; 105) and at least in part defining said convergent lateral boundaries (46, 46, FIG. 7) of said coupling head (25; 105), the top wings (65.1, FIG. 9) engaging (FIG. 2) the top major face of the associated disk (22) at disk locations (FIG. 2) where no other portion of the respective coupling head (25; 105) does so, and the bottom wings (65.2) engaging the bottom major face of the associated disk (22) at disk locations where no other portion of the respective coupling head (25; 105) does so, whereby to increase at such disk locations, in the immediate vicinity of said disk-receiving slot (49), and thus in the immediate vicinity of engagement between the coupling head (25; 105) and the apertured disk (22), the transverse breadth of engagement between the former (25; 105) and the latter (22) and thereby increases resistance to forces tending to tilt or twist the coupling head (25; 105) about a radius of the apertured disk (22).

15. A method of erecting a scaffold system of the type set forth in claim 6, including intermixing first and second apertured disks intermixing first and second coupling heads, and intermixing first and second elongate scaffold elements.

16. A method of erecting a scaffold system of the type set forth in one of claims 10, 11, 17, 8, 9, 12, 13 or 14, including using elongate scaffold elements made not of steel but of light metal.

* * * * *